US010865993B2

(12) United States Patent
Bentley

(10) Patent No.: US 10,865,993 B2
(45) Date of Patent: Dec. 15, 2020

(54) COOKING VESSEL SUPPORT SYSTEM HAVING A PASSIVE WIRELESS READER/TRANSPONDER FOR AN INTEGRAL COOKING VESSEL TEMPERATURE MONITORING SYSTEM

(71) Applicants: BSH Home Appliances Corporation, Irvine, CA (US); BSH Hausgeräte GmbH, Munich (DE)

(72) Inventor: Garrett Bentley, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 106 days.

(21) Appl. No.: 16/214,183

(22) Filed: Dec. 10, 2018

(65) Prior Publication Data

US 2020/0182477 A1 Jun. 11, 2020

(51) Int. Cl.
*F23D 14/06* (2006.01)
*F24C 3/12* (2006.01)

(52) U.S. Cl.
CPC ..... *F24C 3/126* (2013.01)

(58) Field of Classification Search
CPC ..... F23C 3/126
USPC ..... 126/39 R, 39 BA, 39 N, 39 J, 39 K
See application file for complete search history.

(56) References Cited

U.S. PATENT DOCUMENTS 7,173,221 B2 * 2/2007 Lerner ..... F23D 14/72 219/445.1
RE42,513 E 7/2011 Clothier
9,470,423 B2 10/2016 Jacob et al.
2003/0196555 A1 * 10/2003 Petersen ..... F24C 3/126 99/325

(Continued)

FOREIGN PATENT DOCUMENTS

DE 102009024236 A1 12/2010
DE 102013218338 A1 3/2015

(Continued)

OTHER PUBLICATIONS

International Search Report PCT/EP2019/084513 dated Mar. 18, 2020.

*Primary Examiner* — Vivek K Shirsat
(74) *Attorney, Agent, or Firm* — Michael E. Tschupp; Andre Pallapies; Brandon G. Braun

(57) ABSTRACT

A cooking appliance including a cooking vessel temperature monitoring and fire prevention system, including a gas burner, a cooking vessel support configured to support a cooking vessel above the gas burner, a temperature sensor integrated with the cooking vessel support, the temperature sensor configured to be in thermal contact with the cooking vessel supported on the cooking vessel support and to detect the temperature of the cooking vessel, a control unit configured to control an operation of the cooking appliance based on the temperature of the cooking vessel detected by the temperature sensor, and a passive wireless connection between the temperature sensor and the control unit, the (Continued)

passive wireless connection including a transponder circuit integrated with the cooking vessel support and in communication with the temperature sensor, and a reader circuit spaced a distance away from the transponder circuit, the reader circuit in communication with the control unit.

20 Claims, 13 Drawing Sheets

(56) References Cited

U.S. PATENT DOCUMENTS

| | | | |
|---|---|---|---|
| 2015/0049785 | A1 | 2/2015 | Burkhardt et al. |

FOREIGN PATENT DOCUMENTS

| | | | |
|---|---|---|---|
| EP | 2094059 | A2 | 8/2009 |
| EP | 2256417 | A2 | 12/2010 |
| JP | H09250755 | A | 9/1997 |
| JP | 2009144985 | A | 7/2009 |

* cited by examiner

COOKING VESSEL SUPPORT SYSTEM HAVING A PASSIVE WIRELESS READER/TRANSPONDER FOR AN INTEGRAL COOKING VESSEL TEMPERATURE MONITORING SYSTEM

FIELD OF THE INVENTION

The present invention is directed to cooking appliance and a cooking vessel support system for a cooking appliance, and more particularly, to a cooking appliance, and cooking vessel support system for a cooking appliance, having a passive wireless reader/transponder for an integral cooking vessel temperature monitoring and fire prevention system integrated into the cooking vessel support system of the cooking appliance.

BACKGROUND OF THE INVENTION

Some modern gas surface cooking units, such as a gas range, stove, or cooktop, have one or more gas burners for heating foodstuff in a cooking vessel, such as a pot, pan, kettle, etc., and commonly include a cooking vessel support, such as a cooking grate, griddle, etc., positioned over one or more burners for supporting the cooking vessel over a burner. Some cooking ranges or cooktops include a cooktop floor (e.g., a spill tray or top sheet of the cooktop) for catching spills, overflows, etc. from the cooking vessel and for concealing other components of the cooking unit, such as gas supply lines.

SUMMARY OF THE INVENTION

The present invention recognizes that, in some circumstances, a temperature of the cooking vessel, or a temperature of a cooking oil, fat, foodstuff, etc. in a cooking vessel can approach or reach an autoignition point, which may result in a fire event that could lead to a potentially destructive or deadly fire, particularly in a circumstance when a cooking vessel is left unattended or unsupervised on a gas surface cooking unit. Currently, a typical solution for preventing a fire associated with a cooking event is a smoke detector/alarm in the home, which alerts a user in a home or residence upon the occurrence of an active fire event (i.e., after an active fire event is in progress). The present invention recognizes that a risk of a fire event can be prevented or minimized by proactively shutting off or reducing a flow of gas to the one or more gas burners before a cooking vessel, or foodstuff, fat, oil, etc. in the cooking vessel, approach or reach conditions for autoignition of common cooking fats, oils, etc. (e.g., canola oil), which are commonly being heated or cooked in a cooking vessel.

The present invention further recognizes that some conventional solutions attempt to prevent a cooking vessel, oil, or fat, etc. from approaching or reaching conditions for autoignition before a fire event occurs by directly monitoring or detecting the temperature of the cooking vessel to detect a pre-ignition point using one or more obtrusive temperature sensors that project from or extend through an opening in the cooktop floor (e.g., a spill tray or top sheet of the cooktop), project from or extend around or through an opening in a burner or burner cap, or extend around or through an opening in a cooking vessel support (e.g., cooking grate) for supporting the cooking vessel, such that a temperature sensor is placed in direct contact with a surface of the cooking vessel to monitor the temperature of the cooking vessel. For example, as shown in FIG. 13, such obtrusive temperature sensors may utilize a resistance temperature detector (RTD) 900, such as a spring loaded resistance temperature detector (RTD), that sticks up, protrudes from, or extends through a hole in a spill tray 106 of the cooktop unit and directly contacts, or is forced into direct contact with, the bottom surface of a cooking vessel 300 when the cooking vessel is rested on the cooking vessel support to directly measure the temperature of the cooking vessel. In other arrangements, an obtrusive temperature sensor may stick up, protrude from, extend through a hole, or extend around the body or burner cap of the burner 102 or a cooking vessel support 104 (e.g., cooking grate) of the cooktop unit. By sticking up, protruding from, or extending through a hole in the spill tray, burner or burner cap, or cooking vessel support of the cooktop unit, such obtrusive temperature sensors create additional places where spilled fluids or overflows undesirably may leak into the area of the cooktop below the cooktop floor (e.g., through an opening in the spill tray or top sheet of the cooktop, burner, etc.), which may result in damage to other components of the appliance. Such obtrusive temperature sensors also result in additional surfaces and components that need cleaning, and create additional surfaces and areas, such as where the obtrusive temperature sensor intersects or rests on other components of the cooktop (e.g., between or around the sensor and the cooktop floor), that are more likely to catch, trap, or accumulate debris from foodstuff, spills, etc., thereby making it more difficult for a user to clean in or around components of the cooktop. Additionally, such obtrusive temperature sensors are visible to a user and commonly do not match the other components of the cooktop unit, thereby detracting from the aesthetical appearance of the appliance to the user.

To solve these and other problems, the present invention provides a cooking appliance having a cooking vessel temperature monitoring and fire prevention system, the cooking appliance including a gas burner, a cooking vessel support configured to support a cooking vessel above the gas burner, a temperature sensor integrated with the cooking vessel support, the temperature sensor configured to be in thermal contact with the cooking vessel supported on the cooking vessel support and to detect the temperature of the cooking vessel. A thermal insulation can be integrated with the support and can separate the temperature sensor from the cooking vessel support.

The present invention further recognizes that cooking vessel supports commonly are removable to permit cleaning of cooktop surfaces, cleaning of the supports, cleaning/maintenance/repairs of components of the gas burners and igniters, etc. Accordingly, a cooking vessel support having an integral temperature sensor may need a power source, such as an electrical wire, to supply power from the cooking appliance to the integral temperature sensor, as well as to convey a signal from the integral temperature sensor to other components of the cooking appliance, such as to a control unit. The present invention recognizes that such electrical wiring may make it difficult to remove or clean around the cooking vessel support. With a wired connection, an electrical connector may be needed to facilitate disconnecting the power and/or signal wires between the temperature sensor and other components of the appliance such that the cooking vessel support can be removed from the appliance. Such a step of disconnecting electrical connectors and removing the cooking vessel support from the appliance may result in a risk of damage to the electrical connection or wiring, or loosing the effectiveness of the connection.

To solve these and other problems, the present invention provides a cooking appliance having a cooking vessel temperature monitoring and fire prevention system, the cooking appliance further including a transponder circuit integrated with the cooking vessel support and arranged in communication with the integral temperature sensor on the cooking vessel support, along with a reader circuit on the cooking appliance, in order to power the integral temperature sensor and transmit temperature data from the temperature sensor to a control unit using passive wireless communication using frequency load modulation. For example, an example of a cooking appliance having a cooking vessel temperature monitoring and fire prevention system includes a gas burner, a cooking vessel support configured to support a cooking vessel above the gas burner, a temperature sensor integrated with the cooking vessel support, the temperature sensor configured to be in thermal contact with the cooking vessel supported on the cooking vessel support and to detect the temperature of the cooking vessel, a control unit configured to control an operation of the cooking appliance based on the temperature of the cooking vessel detected by the temperature sensor, and a passive wireless connection between the temperature sensor and the control unit, the passive wireless connection including a transponder circuit integrated with the cooking vessel support and in communication with the temperature sensor, and a reader circuit spaced a distance away from the transponder circuit, the reader circuit in communication with the control unit. In this and other ways, the integral temperature sensor on the cooking vessel support can be monitored remotely without direct wiring and power to the sensor, thereby facilitating simple and easy removal of the cooking vessel support from the cooking appliance for cleaning, repairs, etc., while minimizing or reducing a risk of damage to components during removal.

In an example, the cooking vessel support can include sensor circuit including a temperature sensor connected to a transponder circuit having, for example, an inductive coil component (e.g., a first inductor coil). The transponder circuit can be disposed on the cooking vessel support. The cooking appliance can include a reader circuit having another inductive coil component (e.g., a second inductor coil) and a power supply can be provided separately from the cooking vessel support, for example, on or under a cooktop floor of the appliance. The reader circuit can be configured as a separate component in communication with a control unit or the control unit can include the reader circuit.

In operation, a magnetic field is generated in the second inductor coil of the reader circuit, which induces a voltage on the first inductor coil of the transponder circuit, wherein the voltage is harvested to power the electronic components of the sensor circuit, which includes the temperature sensor on the cooking vessel support. Components of the transponder and reader circuits then allow the temperature data to be transmitted from the temperature sensor back to the reader circuit. In the appliance, the reader circuit is connected to a control unit, such as a control board, that can be configured, for example, to modulate gas flow to one or more gas burners, thereby controlling the temperature of the cooking vessel on the cooking vessel support (e.g., providing thermostat control of the cooking appliance), and/or to proactively prevent the autoignition of many or most common cooking oils and fats resulting from overheating of the cooking vessel on the gas surface cooking unit before such autoignition occurs, while at the same time providing a gas cooktop fire prevention system that can be implemented easily and inexpensively, and that does not detract from aesthetics of the appliance or hinder the cleanability of the appliance.

In an example, the reader circuit can be arranged to be in relatively close proximity to the transponder for low communication frequency transmission, wherein, for example, a separate reader can be provided for each burner. In another example, the reader circuit can utilize a high transmission frequency such that a single reader circuit can be configured to communicate with a plurality of transponders at one time, for example, over a farther distance.

In these and other ways, the integral temperature sensor on the cooking vessel support can be monitored remotely using passive wireless communication without direct wiring or without a mechanical connection between the cooking vessel support having the integral temperature sensor and other components of the appliance, thereby facilitating simple and easy removal of the cooking vessel support from the cooking appliance for cleaning, repairs, etc., while minimizing or reducing a risk of damage to components during removal of the cooking vessel support. The examples of the present invention also can provide a cooking appliance having a gas surface cooking unit and a gas cooktop fire prevention system that can simply, easily, and proactively prevent the autoignition of many or most common cooking oils and fats resulting from overheating a cooking vessel on the gas surface cooking unit before such autoignition occurs, and/or that can provide thermostat control of the cooking appliance, while at the same time providing a gas cooktop fire prevention system that can be implemented easily and inexpensively, and that does not detract from aesthetics of the appliance or hinder the cleanability of the appliance.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

With reference to FIGS. 1-12, exemplary embodiments of a cooking appliance including a gas surface cooking unit (e.g., gas cooktop) 100 and a cooking vessel temperature monitoring and prevention system 200, will now be described.

Figure 1:
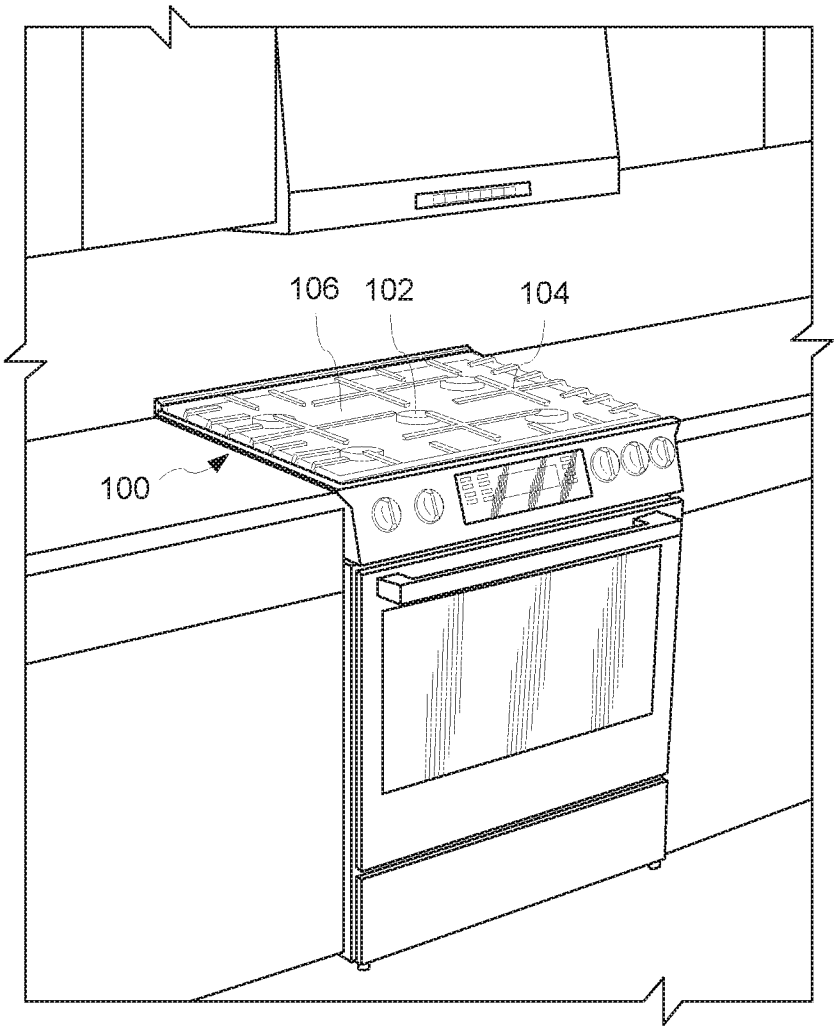
FIG. 1 is a front perspective view of a kitchen with a cooking appliance including a cooktop having a cooking vessel temperature monitoring and prevention system according to an exemplary embodiment of the invention.

FIG. 1 illustrates an example of a kitchen having a gas surface cooking unit 100 having one or more gas burners 102 for heating foodstuff in a cooking vessel, such as a pot, pan, kettle, etc. The gas surface cooking unit 100 can be, for example, a surface cooking unit of a freestanding or slide-in gas range (e.g., a gas cooktop, gas or electric oven combination, dual-fuel range, etc., as shown in the example illustrated in FIG. 1), a gas cooktop or rangetop (e.g., counter mounted, island mounted, etc. as shown in the example illustrated in FIG. 6), a gas stove, a gas grill, a standalone gas burner cooker (e.g., a countertop cooker), etc. The gas surface cooking unit 100 includes a cooking vessel support 104, such as a cooking grate, griddle, grill, teppanyaki grill, etc., positioned over one or more burners 102, or one or more columns, pillars, or the like, positioned around or adjacent to one or more burners 102, for supporting a cooking vessel over at least one of the burners 102. The gas surface cooking unit 100 can include a cooktop floor 106 (e.g., a fixed spill tray or top sheet, a removable spill tray or top sheet, glass surface, etc.) for catching spills, overflows, etc. from a cooking vessel and/or for concealing other components of the cooking unit, such as gas supply lines, electrical wiring, etc. (not visible in FIG. 1). The cooking vessel support 104 can be removable from the gas surface cooking unit 100 (e.g., removable from the cooktop floor 106 for cleaning, repairs, maintenance, etc.) or the cooking vessel support 104 can be fixed to the gas surface cooking unit 100 (e.g., fixed to the cooktop floor 106). In other examples, the cooking vessel support 104 can be moveable with respect to the gas surface cooking unit 100 (e.g., the cooktop floor 106), such as being hinged with respect to the cooktop floor 106 of the gas surface cooking unit 100, or arranged to be elevated or deployed (e.g., one or more columns, pillars, or the like) from a recess in the cooktop floor 106 of the gas surface cooking unit 100, etc.

Figure 2:
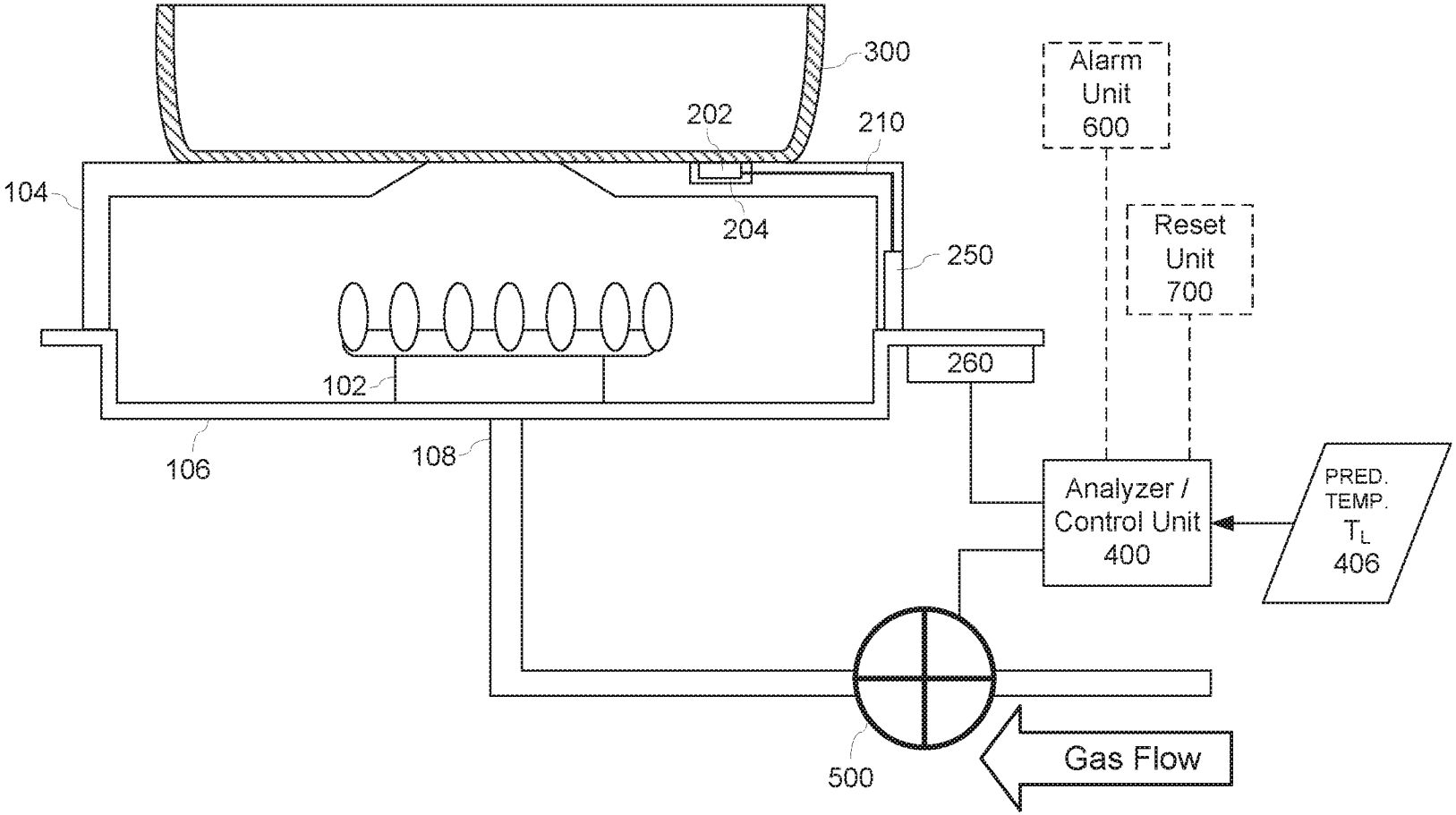
FIG. 2 is a schematic view of a cooktop having a cooking vessel temperature monitoring and prevention system according to an exemplary embodiment of the invention.
Figure 3:
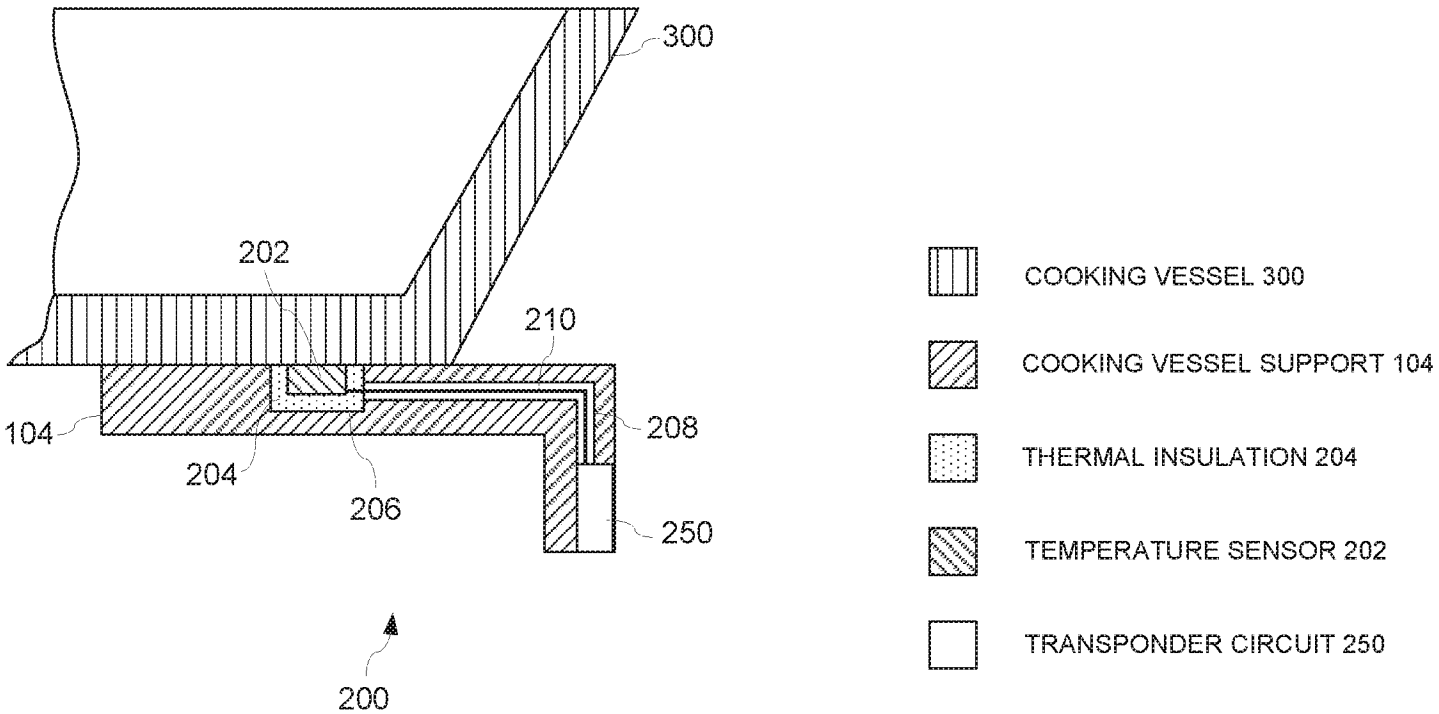
FIG. 3 is a partial cross-sectional view of the cooktop having the cooking vessel temperature monitoring and prevention system according to the exemplary embodiment illustrated in FIG. 2.

FIGS. 2 and 3 illustrate an example of a gas surface cooking unit 100 of a cooking appliance. In this example, the gas surface cooking unit 100 includes one or more gas burners 102, a cooking vessel support 104 (e.g., cooking grate) configured to support a cooking vessel 300 above a gas burner 102. In other examples, the cooking vessel support 104 can be a griddle, grill, or teppanyaki grill, etc. A cooktop floor 106 is disposed below the gas burner 102. The cooktop floor 106 can extend under one or more of the gas burners 102. A gas supply line 108 is disposed under the cooktop floor 106 and supplies gas to the gas burner 102. In other examples, the appliance can include a plurality of gas burners 102. The gas burners 102 can be supplied gas via one or more gas lines 108. For example, a main gas line can supply or convey gas to a gas manifold, which in turn supplies the gas to each respective burner, for example through individual gas lines.

As schematically illustrated in FIGS. 2 and 3, in this example, the cooking appliance includes a cooking vessel temperature monitoring and fire prevention system 200 on (e.g., coupled to, or recessed, embedded, inset, or cast, etc. in) the cooking vessel support 104 (e.g., cooking grate). The cooking vessel temperature monitoring and fire prevention system 200 includes a temperature sensor 202 (e.g., thermocouple, resistance temperature detector (RTD) or element, thermistor, resistance thermometer, etc.) that is coupled to or embedded, inset, or cast within the cooking vessel support 104, and particularly, in a recess or groove 206 formed in an upper surface of a portion of the cooking vessel support 104. The temperature sensor 202 is configured such that an upper surface of the temperature sensor 202 is in thermal contact with a cooking vessel 300 when a cooking vessel 300 is placed on the cooking vessel support 104 (e.g., direct thermal contact in which the upper surface of the temperature sensor 202 directly, physically contacts a surface of the cooking vessel 300).

In an example, an upper surface of the temperature sensor 202 can be flush with an upper surface of the cooking vessel support 104, thereby avoiding or minimizing any projections or obstructions above the cooking vessel support 104 that may interfere with the placement of the cooking vessel 300, catch debris, result in difficulty cleaning the cooking vessel support 104, detract from the aesthetic appearance, etc. In other examples, an upper surface of the temperature sensor 202 can be slightly elevated or raised with respect to an upper surface of the cooking vessel support 104 to promote or improve (e.g., guarantee) contact between the temperature sensor 202 and a surface of the cooking vessel 300, while at the same time minimizing an amount or height of the temperature sensor 202 that is above the cooking vessel support 104 to thereby minimize or avoid interference with the placement of the cooking vessel 300, minimize or avoid an unstable or out-of-level support surface for the cooking vessel 300, and/or minimize or avoid susceptibility to catching debris, which can result in difficulty cleaning the cooking vessel support 104, detract from the aesthetic appearance, etc. For example, if the temperature sensor 202 is raised above an upper surface of the cooking vessel support 104, other components of the cooking vessel support 104 can be configured to avoid a single point (e.g., the temperature sensor 202) elevating the cooking vessel 300, which may create an unstable or out-of-level support surface for the cooking vessel 300. In some examples, one or more additional temperature sensors 202 and/or other components of the cooking vessel support 104 can be provided in a correspondingly raised position such that a level support surface is formed for supporting the cooking vessel 300 in a level and stable position. Such one or more additional temperature sensors 202 and/or other components of the cooking vessel support 104 can be spaced on the cooking vessel support 104 (e.g., on one or more parts, arms, fingers, etc. of the cooking vessel support 104) to provide support for various cooking vessels 300 of one or more sizes, shapes, etc. In other examples, a portion of the cooking vessel support 104 having a raised or elevated temperature sensor 202 can be configured to be correspondingly lower than other components of the cooking vessel support 104 to compensate for the raised or elevated temperature sensor 202, thereby avoiding an unstable or out-of-level support surface for the cooking vessel 300.

As schematically illustrated in FIGS. 2 and 3, one or more, or all, of the surfaces of the temperature sensor 202 that face toward a surface of the cooking vessel support 104 can include (e.g., abut, be coated, or be surrounded by) a thermal insulator or insulation (e.g., high temperature insulation) 204. The thermal insulation 204 thermally isolates or separates the temperature sensor 202 from the walls of the recess or groove 206 and can prevent heat directly from the flame of the gas burner 102 or heat from the cooking vessel support 104 from interfering with a temperature measurement of the cooking vessel 300 by the temperature sensor 202. The cooking vessel support 104 can include a recess, slot, gap, or the like 206 configured to receive and support the temperature sensor 202 and high temperature insulation 204 therein, such that a top of the sensor assembly is in contact with a cooking vessel 300 placed on the cooking vessel support 104. In an example, the temperature sensor 202 and the high temperature insulation 204 can form a sensor assembly (202, 204) that can be inset into a recess or groove 206 of the cooking vessel cooking vessel support 104 so that the temperature sensor 202 is in thermal contact (e.g., direct physical and thermal contact) with a cooking vessel 300 placed on the cooking vessel support 104.

With reference again to the example in FIGS. 2 and 3, the cooking vessel temperature monitoring and fire prevention system 200 includes a transponder circuit 250 (e.g., transponder unit, module, etc.) that is coupled to or embedded, inset, or cast within a portion of the cooking vessel support 104, and a reader circuit 260 (e.g., reader unit, module, etc.) that is, for example, spaced a distance away (e.g., horizontally and/or vertically spaced away) from the transponder circuit 250 such that the reader circuit 260 and the transponder circuit 250 are not in physical contact with each other.

As shown in the examples of FIGS. 2 and 3, the cooking vessel temperature monitoring and fire prevention system 200 can include a transponder circuit 250 (e.g., transponder unit, module, etc.) that is coupled to or embedded, inset, or cast within a portion of the cooking vessel support 104, such as in a recess or groove formed in a base portion of the cooking vessel support 104. The transponder circuit 250 can be configured such that the transponder circuit 250 is in close proximity to the cooktop floor 106 when the cooking vessel support 104 is disposed on the cooktop floor 106 and in position over the gas burner 102 during operation of the cooktop. The transponder circuit 250 can be electrically connected to the temperature sensor 202, for example, by a wire (or wires) 210, such as a high temperature insulated wire, or the transponder circuit 250 can be directly connected to, or integrally formed with, the temperature sensor 202. The cooking vessel support 104 can include a cavity, hollow passageway, or the like 208 for accommodating the wire (or wires) 210, which electrically connecting the temperature sensor 202 to the transponder circuit 250. In some examples, a portion of the cooking vessel support 104 can be formed or cast around the temperature sensor 202, insulation 204, high temperature insulated wire 210, and/or transponder circuit 250, thereby integrally forming one or more of these components with the cooking vessel support 104.

As shown again in the example in FIGS. 2 and 3, the cooking vessel temperature monitoring and fire prevention system 200 can include a reader circuit 260 (e.g., reader unit, module, etc.). The reader circuit 260 can be spaced a distance away from the transponder circuit 250, for example, such that the reader circuit 260 and the transponder circuit 250 are not in physical contact with each other. The reader circuit 260 can be configured such that the reader circuit 260 is in close proximity to the cooktop floor 106 and the transponder circuit 250, which is integrated in the cooking vessel support 104, when the cooking vessel support 104 is disposed on the cooktop floor 106 during operation of the cooktop. In this example, the reader circuit 260 can be coupled to an underside of the cooktop floor 106 such that the reader circuit 260 is in close proximity to the transponder circuit 250, while at the same time, be hidden from view to a user and preventing the reader circuit 260 from being exposed to spills, foodstuff, etc., thereby improving cleanability. The reader circuit 260 can be electrically connected to and in communication with, for example, a control unit 400 (e.g., control circuit, analyzer, analytical controller, etc.) of the surface cooking unit 100 (or a control unit of an appliance having such a surface cooking unit 100). The reader circuit 260 can have a separate power source or be powered by the electrical connection with the control unit 400.

In this and other ways, the cooking vessel temperature monitoring and fire prevention system 200 can power an integral temperature sensor 202, which is configured to be in direct thermal contact with the cooking vessel 300 supported on the cooking vessel support 104 and can accurately detect the temperature of the cooking vessel 300, and transmit temperature data from the temperature sensor 202 to a control unit 400 using a passive wireless connection between the transponder circuit 250 integrated with the cooking vessel support 104 and a reader circuit 260, which is spaced a distance away from the transponder circuit 250 and is configured to communicate with the control unit 400. The integral temperature sensor 202 on the cooking vessel support 104, therefore, can be monitored remotely without direct wiring and power to the integral temperature sensor 202, thereby facilitating simple and easy removal of the cooking vessel support 104 from the cooking appliance for cleaning, repairs, etc., while minimizing or reducing a risk of damage to components during removal.

The passive wireless connection between a transponder circuit 250 integrated with the cooking vessel support 104 and a reader circuit 260 is not limited to any particular arrangement, and can utilize, for example, Radio Frequency Identification (RFID) systems (e.g., passive RFID, battery-free RFID, power-free RFID systems, etc.), Near Field Communication (NFC) systems, among other passive wireless communication systems. Such examples of a passive wireless communication system can include, for example, a transponder circuit (e.g., transponder system) which can include, for example, a connection to the temperature sensor, a logic controller, and a power harvesting system that includes an antenna/coil, a load modulator, etc., and a reader circuit (e.g., reader system), which can include, for example, a power supply, a data input/output, an antenna/coil, and a diplexer, etc. In operation, the power supply of the reader circuit passes energy to the transponder using electromagnetic energy of a specified frequency (which may be predetermined based on the application, design, and requirements of the cooking vessel temperature monitoring and fire prevention system 200 for a particular cooking appliance). The electromagnetic energy is received by the power harvesting components of the transponder circuit, thereby inducing power in the transponder circuit such that the integral temperature sensor 202 operates to detect the temperature of the cooking vessel 300. The information or signal representing the temperature reading from the temperature sensor 202 can then be input through, for example, a logic controller of the transponder circuit 250, which then changes the electrical load of a transponder coil (i.e., load modulation) which is detected by a corresponding coil of the reader circuit, and converted by the reader circuit into useful data regarding the temperature of the cooking vessel 300.

An example arrangement and operation of a transponder circuit 250 and reader circuit 260 will now be described with reference to FIGS. 4 and 5. In this example, the cooking vessel support 104 can include a sensor circuit (e.g., 202, 250) including a temperature sensor 202 connected to a transponder circuit 250 having, for example, a first inductor coil 252, as shown in FIG. 5. As explained, the transponder circuit 250 can be disposed on or integrated in the cooking vessel support 104. The cooking vessel temperature monitoring and fire prevention system 200 correspondingly can include a reader circuit 260 having a second inductor coil 262, as shown in FIG. 5. The reader circuit 260 can be configured as a separate component in communication with a control unit 400, or the reader circuit 260 can be integrated into the control unit 400. The reader circuit 260 can be powered by a power supply 402, either directly or via the control unit 400. In operation, a magnetic field is generated in the second inductor coil 262 of the reader circuit 260, which induces a voltage on the first inductor coil 252 of the transponder circuit 250 across a space, air gap, etc. between second inductor coil 262 and the first inductor coil 252, wherein the voltage is harvested by the transponder circuit 250 to power the electronic components of a sensor circuit, which includes, for example, the temperature sensor 202 on the cooking vessel support 104. Once the temperature sensor 202 is powered, the components of the transponder circuit 250 and the reader circuit 260 can enable the temperature data detected by the temperature sensor 202 to be transmitted from the temperature sensor 202 back to the reader circuit 260. In this example, the reader circuit 260 is connected to a control unit 400, such as a control board, analyzer, etc., that can be configured to receive the temperature data from the temperature sensor 202. The control unit 400 can then process the temperature data and/or compare the temperature data to predetermined temperature data (e.g., $T_L$ 406), for example, to modulate gas flow to one or more gas burners 102, thereby controlling the temperature of the cooking vessel 300 on the cooking vessel support 104 (e.g., providing thermostat control of the cooking appliance), and/or to proactively prevent the autoignition of many or most common cooking oils and fats resulting from overheating of the cooking vessel 300 on the gas surface cooking unit before such autoignition occurs, while at the same time providing a cooking vessel temperature monitoring and fire prevention system 200 that can be implemented easily and inexpensively, and can be monitored remotely without direct wiring and power to the integral temperature sensor 202, thereby facilitating simple and easy removal of the cooking vessel support 104 from the cooking appliance for cleaning, repairs, etc.

In an example, the reader circuit 260 can be arranged to be in relatively close proximity to the transponder circuit 250 for low communication frequency transmission, wherein, for example, a separate transponder circuit 250 and reader circuit 260 can be provided for each burner 102 of the appliance. In this example, each transponder circuit 250 can be integrated into a portion of one or more cooking vessel supports 104 and a reader circuit 260 can be disposed in close proximity to each of the transponder circuits 250, such as under the cooktop floor 106 near each respective transponder circuit 250. The reader circuits 260 can be configured to communicate with a single control unit 400 and/or a single power source, or one or more reader circuits 260 can communicate with one or more control units 400.

In another example, the reader circuit 260 can utilize a high transmission frequency such that a single reader circuit 260 can be configured to communicate with a plurality of transponder circuits 250 at one time, for example, over a farther distance. In this example, each transponder circuit 250 can be integrated into a portion of one or more cooking vessel supports 104 and a single reader circuit 260 can be disposed in close proximity to all of the transponder circuits 250 (e.g., within a predetermined range, centrally located with respect to, etc.), such as under the cooktop floor 106. The reader circuit 260 can be configured to communicate with a single control unit 400 and/or a single power source. In other examples, more than one reader circuit 260 can be provided, with each reader circuit 260 being arranged in communication with a plurality of transponder circuits 250.

According to the example features of the invention, the integral temperature sensor 202 on the cooking vessel support 104 can be monitored remotely without direct wiring or a mechanical connection using a passive wireless connection between the cooking vessel support 104 having the integral temperature sensor 202 and other components of the appliance, thereby facilitating simple and easy removal of the cooking vessel support 104 from the cooktop floor 106 for cleaning, repairs, etc., while minimizing or reducing a risk of damage to components during removal of the cooking vessel support 104. The examples of the present invention also can provide a cooking appliance having a gas surface cooking unit 100 and a gas cooktop fire prevention system that can simply, easily, and proactively prevent the autoignition of many or most common cooking oils and fats resulting from overheating a cooking vessel on the gas surface cooking unit before such autoignition occurs, and/or that can provide thermostat control of the cooking appliance, while at the same time providing a cooking vessel temperature monitoring and fire prevention system 200 that can be implemented easily and inexpensively, and that does not detract from aesthetics of the appliance or hinder the cleanability of the appliance. The example features of the invention also enable the integral temperature sensor 202 to integrated in the cooking vessel support 104 in various ways and in various locations without detrimentally affecting the aesthetics of the appliance or the cleanability of the appliance.

Figure 9:
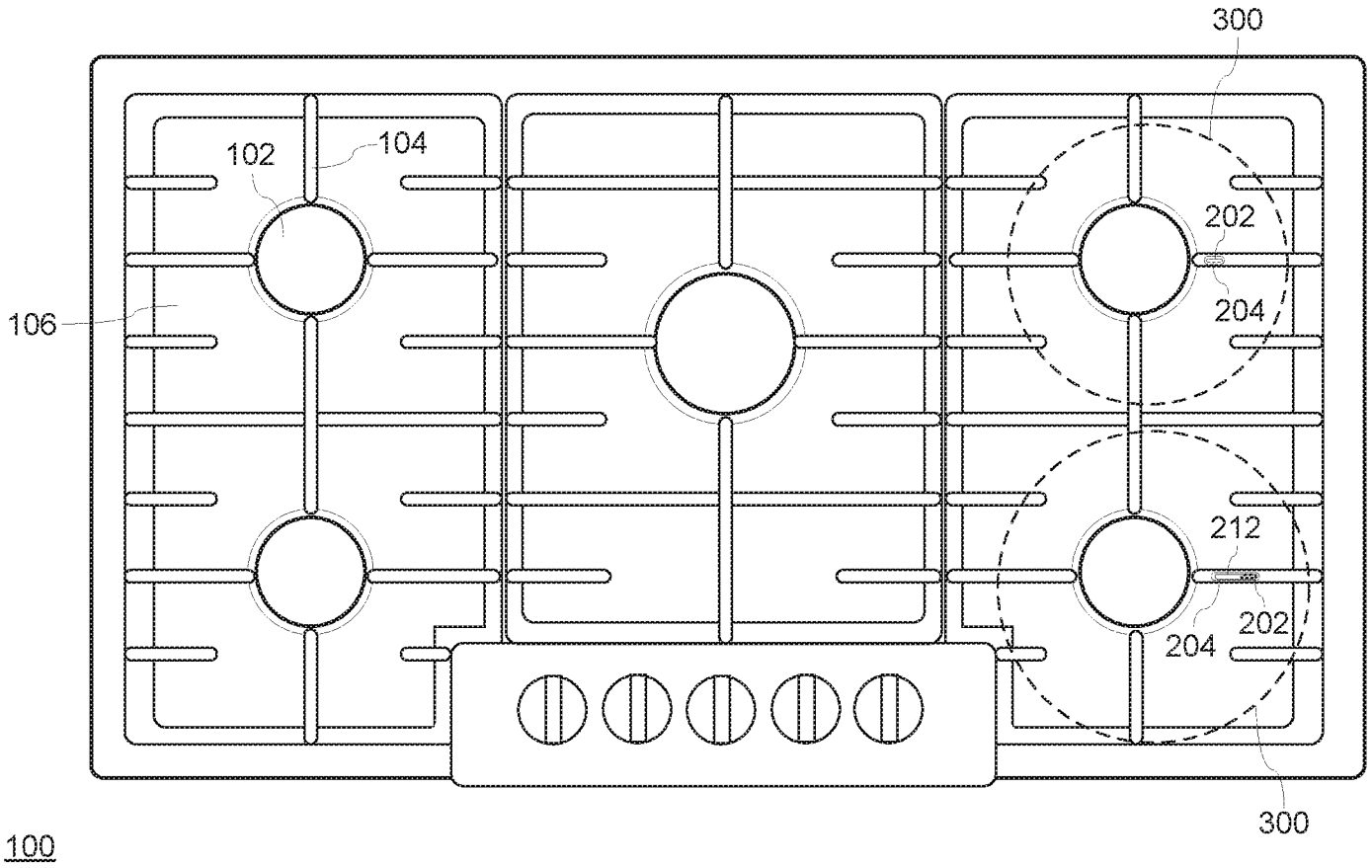
FIG. 9 is a plan view of a cooking appliance including a cooking vessel temperature monitoring and prevention system according to exemplary embodiments of the invention.

The arrangement of the temperature sensor 202 integrated into the cooking vessel support 104 is not limited to any particular arrangement. For example, FIG. 9 illustrates an example (top right corner) of a cooking vessel temperature monitoring and fire prevention system 200, which is similar to the example in FIGS. 2 and 3, including a temperature sensor 202 (e.g., thermocouple, resistance temperature detector (RTD) or element, thermistor, resistance thermometer, etc.) that is coupled to or embedded, inset, or cast within the cooking vessel support 104 such that an upper surface of the temperature sensor 202 is in thermal contact (e.g., direct physical and thermal contact) with a cooking vessel 300 when a cooking vessel 300 is placed on the cooking vessel support 104 (schematically illustrated using dashed lines in FIG. 9). An example of these features also is shown in the enlarged view of a cooking vessel support 104 illustrated in FIG. 10A.

In the examples of FIGS. 2, 3, 9, and 10A, the cooking vessel temperature monitoring and fire prevention system 200 includes thermal insulation 204 arranged to thermally isolate or separate the temperature sensor 202 from the walls of a recess or groove 206 of the cooking vessel support 104 to thereby prevent heat directly from the flame of the gas burner 102 or heat from the cooking vessel support 104 from interfering with a temperature measurement of the cooking vessel 300 by the temperature sensor 202. An upper surface of the thermal insulation 204 can be flush with an upper surface of the cooking vessel support 104, thereby avoiding or minimizing any projections or obstructions above the cooking vessel support 104 that may interfere with the placement of the cooking vessel 300, catch debris, or result in difficulty cleaning the cooking vessel support 104, etc. The upper surface of the thermal insulation 204 can be flush with an upper surface of the temperature sensor 202 if the temperature sensor 202 is flush with the upper surface of the cooking vessel support 104, or the upper surface of the temperature sensor 202 can be elevated or raised with respect to the upper surface of the thermal insulation 204 and the upper surface of the cooking vessel support 104.

Figure 10B:
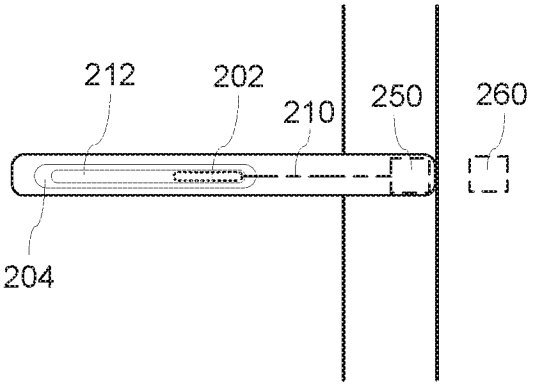
FIGS. 10A-10D are partial plan views of a cooking appliance including a cooking vessel temperature monitoring and prevention system according to exemplary embodiments of the invention.
Figure 10D:
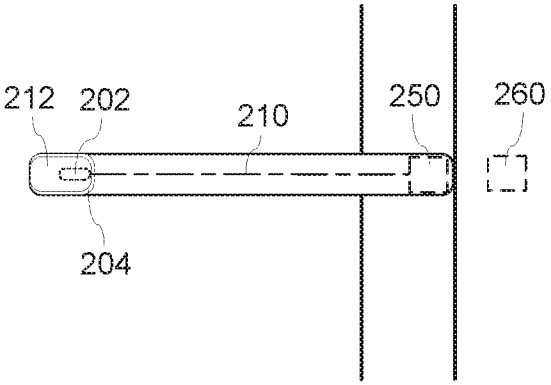
Figure 10A:
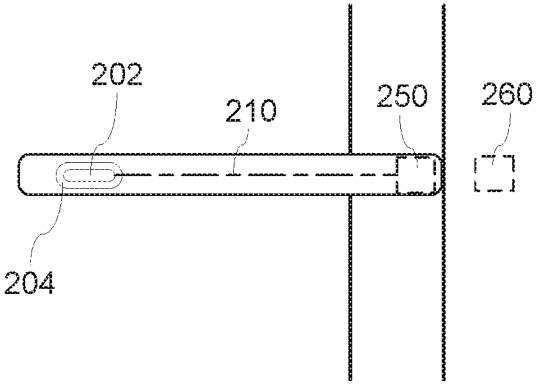
Figure 10C:
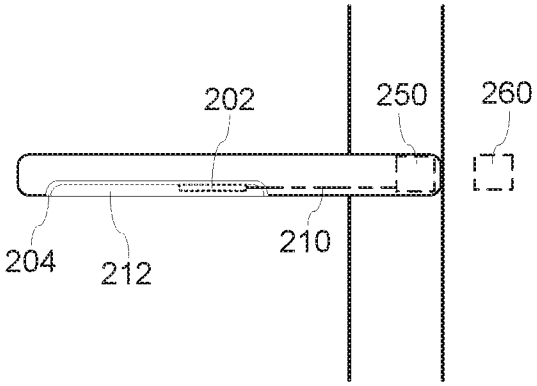

With reference again to the examples in FIGS. 9 and 10A, the temperature sensor 202 can be embedded, inset, or cast within an upper surface of the cooking vessel support 104 in a central location with respect to a width of a portion (e.g., along a longitudinal axis of an arm or finger) of the cooking vessel support 104. In other examples, the temperature sensor 202 can be embedded, inset, or cast in an upper surface of the cooking vessel support 104 at a location that is offset to one side or the other. In other examples, the temperature sensor 202 can be embedded, inset, or cast in a side surface or edge surface of the cooking vessel support 104 such that an upper surface of the temperature sensor 202 is in thermal contact (e.g., direct physical and thermal contact) with a cooking vessel 300 when a cooking vessel 300 is placed on the cooking vessel support 104. Other examples are illustrated in FIG. 9 and will be described below.

In the examples of FIGS. 2, 3, 9, and 10A, the cooking vessel temperature monitoring and fire prevention system 200 includes a transponder circuit 250 (e.g., transponder unit, module, etc.) that is coupled to or embedded, inset, or cast within a portion of the cooking vessel support 104, such as in a recess or groove formed in a base portion of the cooking vessel support 104 (e.g., as schematically illustrated in FIGS. 2 and 3, and shown using dashed lines in FIG. 10A). The transponder circuit 250 can be configured such that the transponder circuit 250 is in close proximity to the cooktop floor 106 when the cooking vessel support 104 is disposed on the cooktop floor 106 and in position over the gas burner 102 during operation of the cooktop. The transponder circuit 250 can be electrically connected to the temperature sensor 202, for example, by a wire (or wires) 210, such as a high temperature insulated wire, or the transponder circuit 250 can be directly connected to, or integrally formed with, the temperature sensor 202. The cooking vessel temperature monitoring and fire prevention system 200 also includes a reader circuit 260 (e.g., reader unit, module, etc.). The reader circuit 260 can be configured to be spaced a distance away (e.g., horizontally and/or vertically spaced away) from the transponder circuit 250, for example, that the reader circuit 260 and the transponder circuit 250 are not in physical contact with each other (e.g., as schematically illustrated in FIGS. 2 and 3, and shown using dashed lines in FIG. 10A). The reader circuit 260 can be configured such that the reader circuit 260 is in close proximity to the cooktop floor 106 and the transponder circuit 250, which is integrated in the cooking vessel support 104, when the cooking vessel support 104 is disposed on the cooktop floor 106 during operation of the cooktop. In this example, the reader circuit 260 is coupled to an underside of the cooktop floor 106 such that the reader circuit 260 is in close proximity to the transponder circuit 250, while at the same time, be hidden from view.

Figure 6:
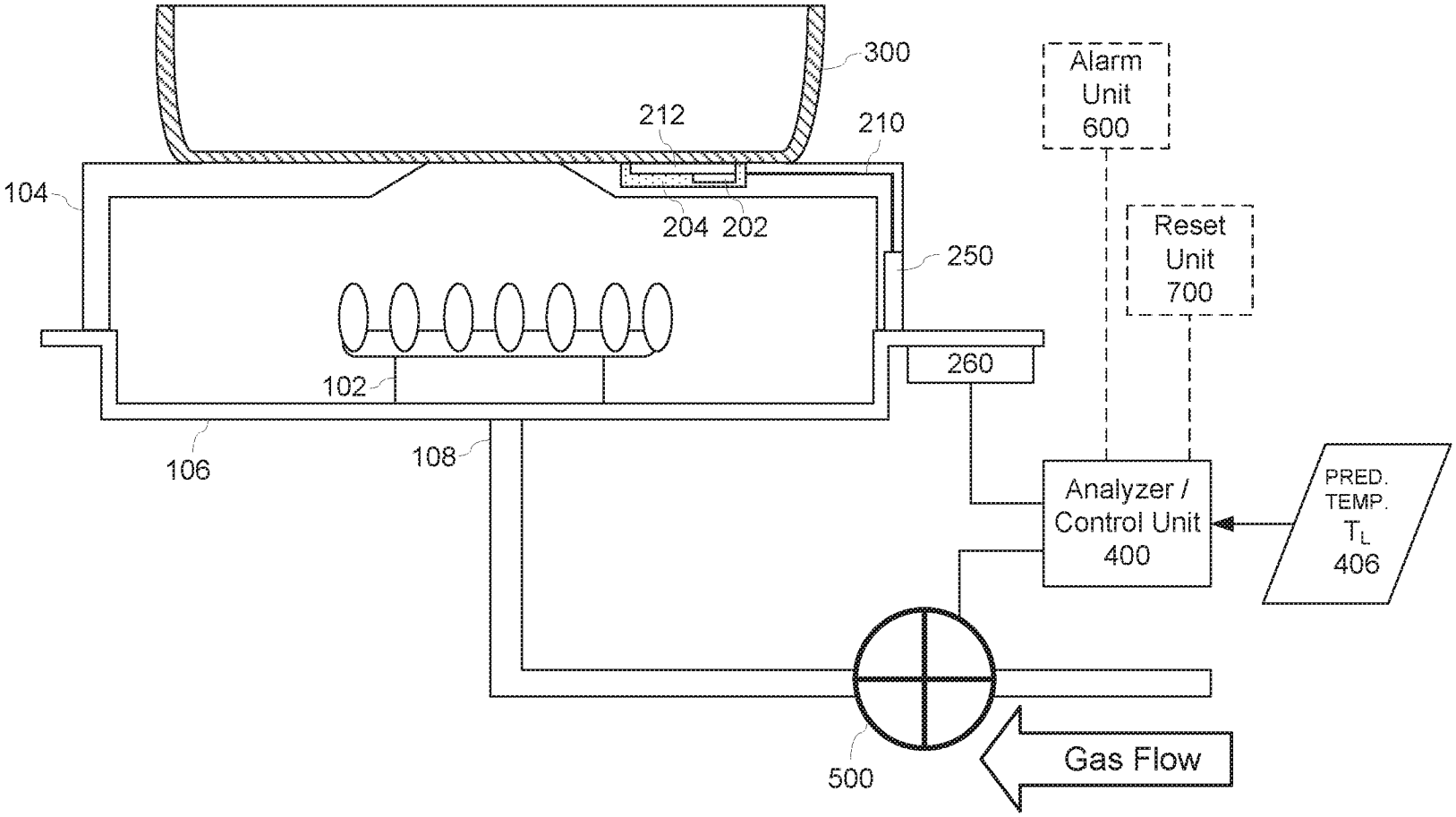
FIG. 6 is a schematic view of a cooktop having a cooking vessel temperature monitoring and prevention system according to an exemplary embodiment of the invention.
Figure 7:
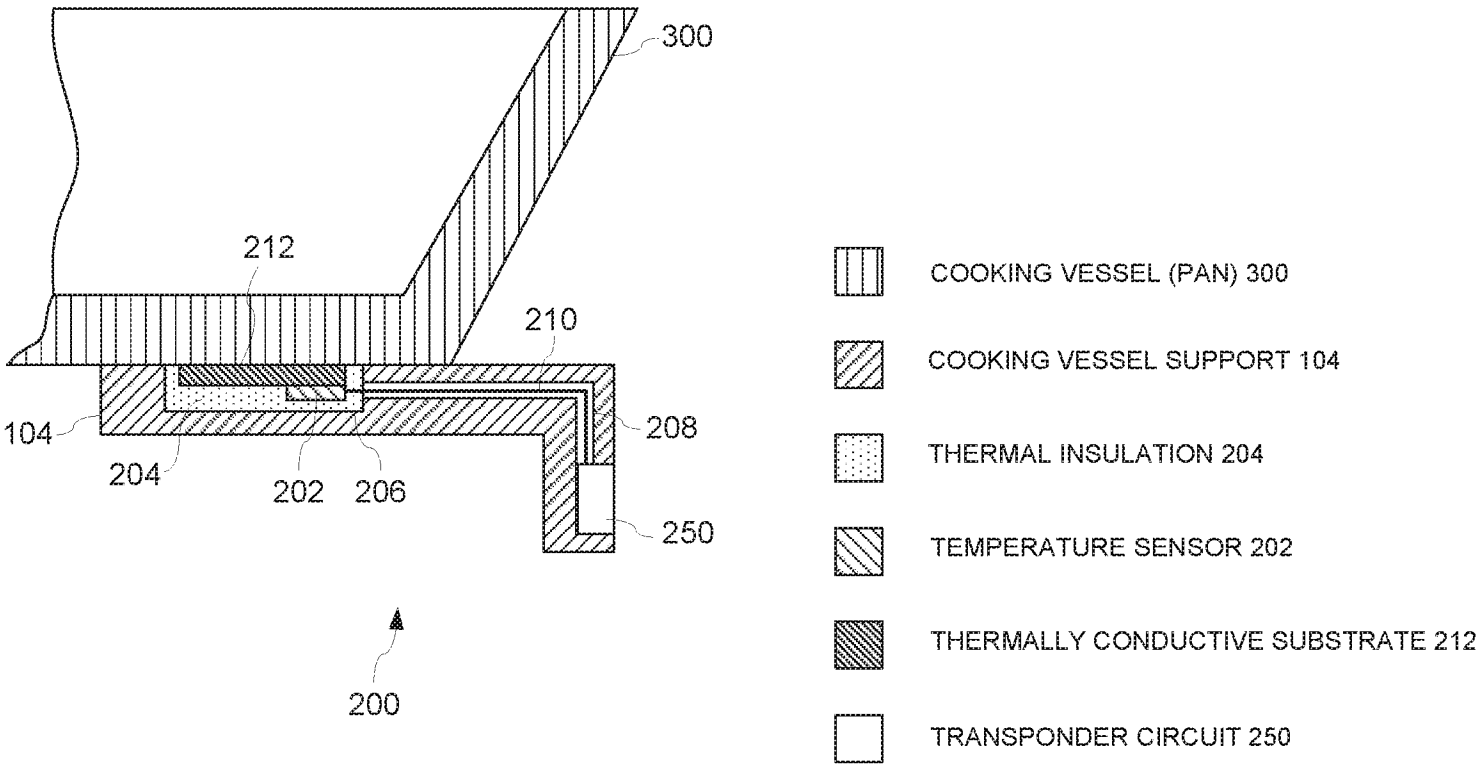
FIG. 7 is a partial cross-sectional view of the cooktop having the a cooking vessel temperature monitoring and prevention system according to the exemplary embodiment illustrated in FIG. 6.

FIGS. 6 and 7 illustrate another example of a gas surface cooking unit 100 including a cooking vessel temperature monitoring and fire prevention system 200 on (e.g., coupled to, or recessed, embedded, inset, or cast, etc. in) the cooking vessel support 104 (e.g., cooking grate). The cooking vessel temperature monitoring and fire prevention system 200 includes a temperature sensor 202 (e.g., thermocouple, resistance temperature detector (RTD) or element, thermistor, resistance thermometer, etc.) that is embedded, inset, or cast within the cooking vessel support 104, such as in a recess or groove 206 formed in an upper surface of a portion of the cooking vessel support 104. In this example, the cooking vessel temperature monitoring and fire prevention system 200 includes a thermally conductive substrate 212 (e.g., a durable, thermally conductive material such as iron, steel, brass, or the like) in thermal contact (e.g., direct physical and thermal contact) with the temperature sensor 202 and configured such that a surface (e.g., an upper surface) of the thermally conductive substrate 212 is in thermal contact with a cooking vessel 300 when the cooking vessel 300 is placed on the cooking vessel support 104 (e.g., direct thermal contact in which the upper surface of the thermally conductive substrate 212 directly, physically contacts a surface of the cooking vessel 300). As shown in FIG. 7, a lower surface of the thermally conductive substrate 212 can be arranged in contact with an upper surface of the temperature sensor 202. However, in other examples, one or more surfaces (e.g., upper surface, side surface, lower surface, end surface, edge surface, corner, etc.) of either the thermally conductive substrate 212 or the temperature sensor 202 can be arranged in thermal contact (e.g., direct physical and thermal contact) with each other (e.g., a surface or part of the temperature sensor 202 abuts, is embedded, cast, inset, recessed in, etc., the thermally conductive substrate 212).

As explained, the thermally conductive substrate 212 shown in FIG. 7 is configured such that an upper surface of the thermally conductive substrate 212 is in thermal contact (e.g., direct physical and thermal contact) with a cooking vessel 300 when the cooking vessel is placed on the cooking vessel support 104, and another surface (e.g., side surface, lower surface, end surface, edge surface, etc.) of the thermally conductive substrate 212 is in thermal contact (e.g., direct physical and thermal contact) with a surface or part of the temperature sensor 202. In an example, an upper surface of the thermally conductive substrate 212 can be flush with an upper surface of the cooking vessel support 104, thereby avoiding or minimizing any projections or obstructions above the cooking vessel support 104 that may interfere with the placement of the cooking vessel 300, catch debris, result in difficulty cleaning the cooking vessel support 104, detract from the aesthetic appearance, etc.

In other examples, an upper surface of the thermally conductive substrate 212 can be slightly elevated or raised with respect to an upper surface of the cooking vessel support 104 to promote or improve (e.g., guarantee) contact between the thermally conductive substrate 212 and a surface of the cooking vessel 300, while at the same time minimizing an amount or height of the thermally conductive substrate 212 that is above the cooking vessel support 104 to thereby minimize or avoid interference with the placement of the cooking vessel 300, minimize or avoid an unstable or out-of-level support surface for the cooking vessel 300, and/or minimize or avoid susceptibility to catching debris, which can result in difficulty cleaning the cooking vessel support 104, detract from the aesthetic appearance, etc. For example, if the thermally conductive substrate 212 is raised above an upper surface of the cooking vessel support 104, other components of the cooking vessel support 104 can be configured to avoid a single point (e.g., the thermally conductive substrate 212) elevating the cooking vessel 300, which may create an unstable or out-of-level support surface for the cooking vessel 300. In some examples, one or more additional thermally conductive substrates 212 and/or other components of the cooking vessel support 104 can be provided in a correspondingly raised position such that a level support surface is formed for supporting the cooking vessel 300 in a level and stable position. Such one or more additional thermally conductive substrates 212 and/or other components of the cooking vessel support 104 can be spaced on the cooking vessel support 104 (e.g., on one or more parts, arms, fingers, etc. of the cooking vessel support 104) to provide support for various cooking vessels 300 of one or more sizes, shapes, etc. In other examples, a portion of the cooking vessel support 104 having a raised or elevated thermally conductive substrate 212 can be configured to be correspondingly lower than other components of the cooking vessel support 104 to compensate for the raised or elevated thermally conductive substrate 212, thereby avoiding an unstable or out-of-level support surface for the cooking vessel 300.

As shown in FIGS. 6 and 7, a thermal insulation 204 can be provided to separate (e.g., thermally isolate) the thermally conductive substrate 212 and the temperature sensor 202 from the cooking vessel support 104 (e.g., walls of the recess or groove 206 of the cooking vessel support 104), thereby preventing heat directly from the flame of the gas burner 102, or heat from the cooking vessel support 104 from being conveyed or conducted to the thermally conductive substrate 212 and the temperature sensor 202, thereby minimizing or avoiding interference with a temperature measurement ($T_I$) of the cooking vessel 300 by the temperature sensor 202. An upper surface of the thermal insulation 204 can be flush with an upper surface of the cooking vessel support 104, thereby avoiding or minimizing any projections or obstructions above the cooking vessel support 104 that may interfere with the placement of the cooking vessel 300, catch debris, or result in difficulty cleaning the cooking vessel support 104, etc. The upper surface of the thermal insulation 204 can be flush with an upper surface of the thermally conductive substrate 212 if the thermally conductive substrate 212 is flush with the upper surface of the cooking vessel support 104, or the upper surface of the thermally conductive substrate 212 can be elevated or raised with respect to the upper surface of the thermal insulation 204 and the upper surface of the cooking vessel support 104. In some examples, the thermally conductive substrate 212, the temperature sensor 202, and the high temperature insulation 204 can form a sensor assembly (202, 204, 212) that can be inset into a recess or groove 206 of the cooking vessel cooking vessel support 104 so that the thermally conductive substrate 212 is in thermal contact (e.g., direct physical and thermal contact) with a cooking vessel 300 placed on the cooking vessel support 104.

With reference again to FIG. 9, another example is illustrated (bottom right corner) of a cooking vessel temperature monitoring and fire prevention system 200, similar to the example in FIGS. 6 and 7, including a temperature sensor 202 (e.g., thermocouple, resistance temperature detector (RTD) or element, thermistor, resistance thermometer, etc.) that is coupled to or embedded, inset, or cast within the cooking vessel support 104, and a thermally conductive substrate 212 (e.g., a durable, thermally conductive material such as iron, steel, brass, or the like) in thermal contact (e.g., direct physical and thermal contact) with the temperature sensor 202 and configured such that a surface (e.g., an upper surface) of the thermally conductive substrate 212 is in thermal contact (e.g., direct physical and thermal contact) with a cooking vessel 300 when the cooking vessel 300 is placed on the cooking vessel support 104 (schematically illustrated using dashed lines in FIG. 9). Examples of these features are shown in the enlarged views of a cooking vessel support illustrated in FIGS. 10B-10D. An upper surface of the thermally conductive substrate 212 can be flush with an upper surface of the cooking vessel support 104, thereby avoiding or minimizing any projections or obstructions above the cooking vessel support 104 that may interfere with the placement of the cooking vessel 300, catch debris, or result in difficulty cleaning the cooking vessel support 104, etc., or an upper surface of the thermally conductive substrate 212 can be slightly elevated or raised with respect to an upper surface of the cooking vessel support 104 to promote or improve (e.g., guarantee) contact between the thermally conductive substrate 212 and a surface of the cooking vessel 300, as explained with reference to FIGS. 6 and 7. The cooking vessel temperature monitoring and fire prevention system 200 includes a thermal insulation 204 arranged to thermally isolate or separate the thermally conductive substrate 212 and the temperature sensor 202 from the cooking vessel support 104 to thereby prevent heat directly from the flame of the gas burner 102 or heat from the cooking vessel support 104 from interfering with a temperature measurement ($T_I$) of the cooking vessel 300 by the temperature sensor 202.

As shown in the examples of FIGS. 9 and 10B, the thermally conductive substrate 212 and/or the temperature sensor 202 can be embedded, inset, or cast within an upper surface of the cooking vessel support 104 in a central location with respect to a width of a portion (e.g., along a longitudinal axis of an arm or finger) of the cooking vessel support 104. In other examples, the thermally conductive substrate 212 and/or the temperature sensor 202 can be embedded, inset, or cast in an upper surface of the cooking vessel support 104 at a location that is offset to one side or the other. In other examples, the thermally conductive substrate 212 and/or the temperature sensor 202 can be embedded, inset, or cast in a side surface or edge surface of the cooking vessel support 104 such that an upper surface of the thermally conductive substrate 212 is in thermal contact (e.g., direct physical and thermal contact) with a cooking vessel 300 when a cooking vessel 300 is placed on the cooking vessel support 104. Examples of these features are shown in the enlarged views of a cooking vessel support illustrated in FIGS. 10C and 10D.

As shown for example in FIG. 7, the size (e.g., surface area) of the portion of the thermally conductive substrate 212, which is arranged to contact a surface of the cooking vessel 300, can be greater than the size (e.g., surface area) of the temperature sensor 202 to improve thermal conductivity between the cooking vessel 300 and the thermally conductive substrate 212, and correspondingly to improve thermal conductivity with the temperature sensor 202. However, in other examples, the size (e.g., surface area) of the portion of the thermally conductive substrate 212, which is arranged to contact the surface of the cooking vessel 300, can be equal to the size (e.g., surface area) of the temperature sensor 202 or the contact area with the temperature sensor 202. In still other examples, the size (e.g., surface area) of the portion of the thermally conductive substrate 212, which is arranged to contact the surface of the cooking vessel 300, can be less than the size (e.g., surface area) of the temperature sensor 202, for example, in an instance in which the thermally conductive substrate 212 is formed from a material having a greater thermal conductivity than that of a material of the temperature sensor 202.

In some examples, the thermally conductive substrate 212 can be formed from a material having a higher durability (e.g., resistance to wear, scratching, abrasions, indentations, pressure, or other damage, etc.) than the material of the temperature sensor 202. In this way, the cooking vessel temperature monitoring and fire prevention system 200 can be integrated into the cooking vessel support 104 without affecting or lowering the durability of the cooking vessel support 104. In addition, by avoiding or minimizing a potential for damage to the temperature sensor 202 or the cooking vessel support 104, the thermally conductive substrate 212 can avoid or minimize a deterioration over time of the aesthetic appearance of the cooking vessel support 104. By embedding the thermally conductive substrate 212 into a portion of the cooking vessel support 104 and configuring an upper surface of the thermally conductive substrate 212 to be flush with an upper surface of the cooking vessel support 104, the examples can avoid or minimize projections or obstructions above the cooking vessel support 104 that may interfere with the placement of the cooking vessel 300, catch debris, result in difficulty cleaning the cooking vessel support 104, detract from the aesthetic appearance, etc.

In the examples of FIGS. 6, 7, 9, and 10B-10D, the cooking vessel temperature monitoring and fire prevention system 200 includes a transponder circuit 250 (e.g., transponder unit, module, etc.) that is coupled to or embedded, inset, or cast within a portion of the cooking vessel support 104, such as in a recess or groove formed in a base portion of the cooking vessel support 104. The transponder circuit 250 can be configured such that the transponder circuit 250 is in close proximity to the cooktop floor 106 when the cooking vessel support 104 is disposed on the cooktop floor 106 and in position over the gas burner 102 during operation of the cooktop. The transponder circuit 250 can be electrically connected to the temperature sensor 202, for example, by a wire (or wires) 210, such as a high temperature insulated wire, or the transponder circuit 250 can be directly connected to, or integrally formed with, the temperature sensor 202. The cooking vessel temperature monitoring and fire prevention system 200 also includes a reader circuit 260 (e.g., reader unit, module, etc.). The reader circuit 260 can be configured to be spaced a distance away (e.g., horizontally and/or vertically spaced away) from the transponder circuit 250, for example, that the reader circuit 260 and the transponder circuit 250 are not in physical contact with each other. The reader circuit 260 can be configured such that the reader circuit 260 is in close proximity to the cooktop floor 106 and the transponder circuit 250, which is integrated in the cooking vessel support 104, when the cooking vessel support 104 is disposed on the cooktop floor 106 during operation of the cooktop. In this example, a reader circuit 260 is coupled to an underside of the cooktop floor 106 such that the reader circuit 260 is in close proximity to the transponder circuit 250, while at the same time, be hidden from view. In some examples, a single reader circuit 260 can be configured to communicate with a single transponder circuit 250 (e.g., a single reader circuit 260 for each respective transponder circuit 250, as schematically illustrated in FIGS. 2, 6, and 10A-10D), or in other examples, a reader circuit 260 can be configured to communicate with a plurality of transponder circuits 250 at one time over a farther distance. In the latter example, each transponder circuit 250 can be integrated into a portion of one or more cooking vessel supports 104 and a single reader circuit 260 can be disposed, for example, in close proximity to all of the transponder circuits 250 (e.g., within a predetermined range, centrally located with respect to, etc.), such as under the cooktop floor 106. The reader circuit 260 can be configured to communicate with a single control unit 400 and/or a single power source, or one or more reader circuits 260 can communicate with one or more control units 400.

Figure 8:
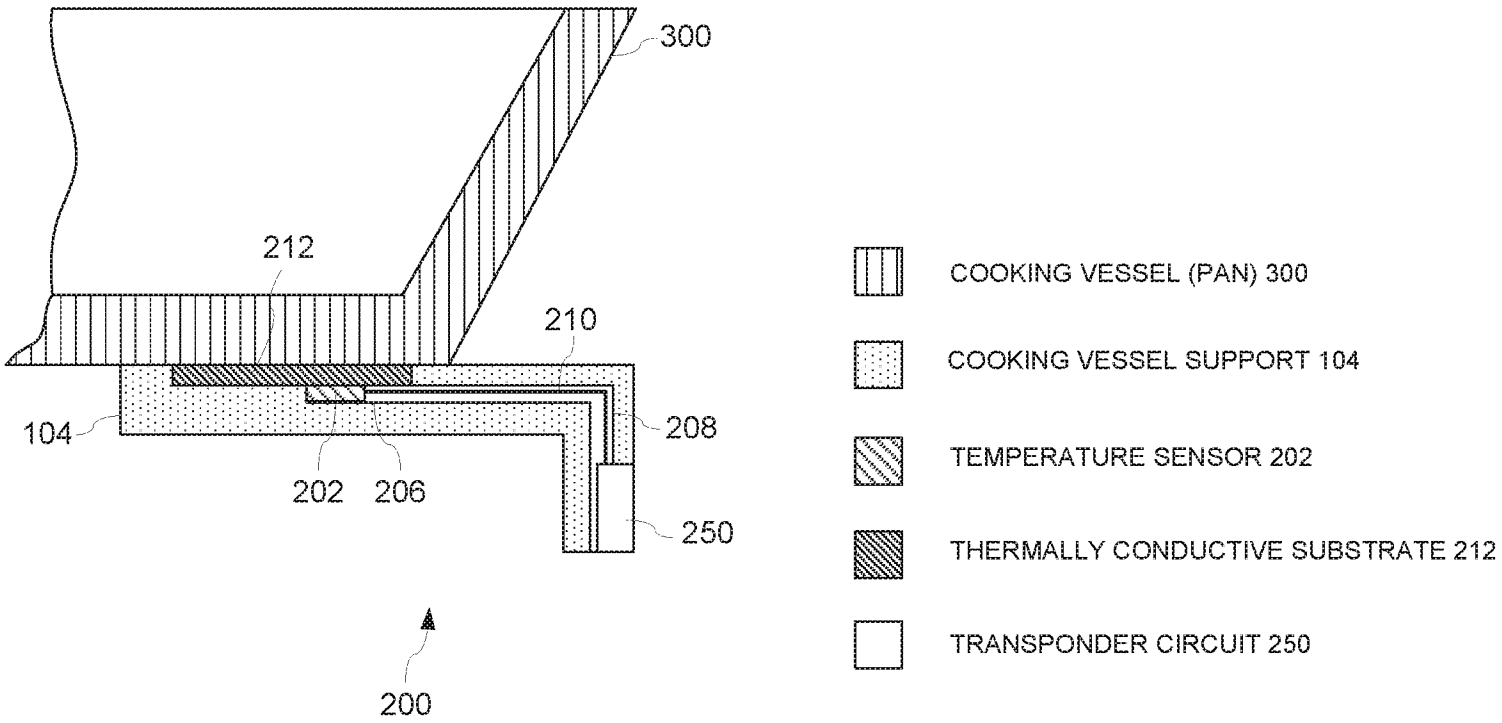
FIG. 8 is a partial cross-sectional view of the cooktop having a cooking vessel temperature monitoring and prevention system according to another exemplary embodiment.

FIG. 8 illustrates another example of a gas surface cooking unit 100 including a cooking vessel temperature monitoring and fire prevention system 200 on (e.g., coupled to, recessed, embedded, inset, or cast in, etc.) the cooking vessel support 104 (e.g., cooking grate). The cooking vessel temperature monitoring and fire prevention system 200 includes a temperature sensor 202 (e.g., thermocouple, resistance temperature detector (RTD) or element, thermistor, resistance thermometer, etc.) that is embedded, inset, or cast within the cooking vessel support 104, such as in a recess or groove 206 formed in an upper surface of a portion of the cooking vessel support 104. In this example, the cooking vessel temperature monitoring and fire prevention system 200 includes a thermally conductive substrate 212 (e.g., a durable, thermally conductive material such as iron, steel, brass, or the like) in thermal contact (e.g., direct physical and thermal contact) with the temperature sensor 202 and configured such that a surface (e.g., an upper surface) of the thermally conductive substrate 212 is in thermal contact (e.g., direct physical and thermal contact) with a cooking vessel 300 when the cooking vessel is placed on the cooking vessel support 104. As shown in FIG. 8, a lower surface of the thermally conductive substrate 212 can be arranged in contact with an upper surface of the temperature sensor 202. However, in other examples, one or more surfaces (e.g., upper surface, side surface, lower surface, end surface, edge surface, corner, etc.) of either the thermally conductive substrate 212 or the temperature sensor 202 can be arranged in thermal contact (e.g., direct physical and thermal contact) with each other, or a surface or part of the temperature sensor 202 can abut or be embedded, cast, inset, recessed in, etc., the thermally conductive substrate 212.

As shown in FIG. 8, the size (e.g., surface area) of the portion of the thermally conductive substrate 212, which is arranged to contact a surface of the cooking vessel 300, can be greater than the size (e.g., surface area) of the temperature sensor 202 to improve thermal conductivity between the cooking vessel 300 and the thermally conductive substrate 212, and correspondingly to improve thermal conductivity with the temperature sensor 202. However, in other examples, the size (e.g., surface area) of the portion of the thermally conductive substrate 212, which is arranged to contact the surface of the cooking vessel 300, can be equal to the size (e.g., surface area) of the temperature sensor 202 or the contact area with the temperature sensor 202. In still other examples, the size (e.g., surface area) of the portion of the thermally conductive substrate 212, which is arranged to contact the surface of the cooking vessel 300, can be less than the size (e.g., surface area) of the temperature sensor 202, for example, in an instance in which the thermally conductive substrate 212 is formed from a material having a greater thermal conductivity than that of a material of the temperature sensor 202. Similar to other examples, the thermally conductive substrate 212 can be formed from a material having a higher durability (e.g., resistance to wear, scratching, abrasions, indentations, pressure, or other damage, etc.) than the material of the temperature sensor 202. In this way, a cooking vessel temperature monitoring and fire prevention system 200 can be integrated into the cooking vessel support 104 without affecting or lowering the durability of the cooking vessel support 104. By avoiding or minimizing a potential for damage to the temperature sensor 202 or the cooking vessel support 104, the thermally conductive substrate 212 can avoid or minimize a deterioration of the aesthetic appearance of the cooking vessel support over time.

In this example, the cooking vessel support 104, or a portion thereof (such as all, or part, of an arm or finger portion of the support 104), can be formed from (e.g., cast from, partially cast from, etc.) a thermally insulating material, such as a high temperature (resistant) ceramic, to separate (e.g., thermally isolate) the thermally conductive substrate 212 and the temperature sensor 202 from heat directly from the flame of the gas burner 102, thereby minimizing or avoiding interference with a temperature measurement of the cooking vessel 300 by the temperature sensor 202. In other examples, an insert formed of (e.g., cast, partially cast, etc.) a thermally insulating material, such as a high temperature ceramic, can be coupled to, or recessed, embedded, inset, or cast, etc. in, a part of the cooking vessel support 104. Such an inset of high temperature ceramic can form a sensor assembly along with the thermally conductive substrate 212 and temperature sensor 202. For example, a sensor assembly can include a temperature sensor 202 directly contacting (e.g., coupled to) a thermally conductive substrate 212, such as a brass contact, in which the sensor assembly is disposed in a thermally insulating material 204, such as a cast ceramic, and disposed on, inset in, etc. a cooking vessel support 104, such as steel support (e.g., cast or machined support). In another example, a sensor assembly can include a temperature sensor 202 directly contacting (e.g., coupled to) a thermally conductive substrate 212, such as a brass contact, in which the sensor assembly is disposed in a thermally insulating material 204, such as a fully cast ceramic cooking vessel support 104. In yet another example, a sensor assembly can include a temperature sensor 202 directly contacting (e.g., coupled to) a thermally conductive substrate 212, such as a brass contact, in which the sensor assembly is disposed in a thermally insulating material 204, such as a portion of a cast ceramic cooking vessel support 104 (e.g., a finger or arm portion of a support, which is configured to be coupled to or assembled with other components of a cooking vessel support).

In the examples of FIG. 8, the cooking vessel temperature monitoring and fire prevention system 200 includes a transponder circuit 250 (e.g., transponder unit, module, etc.) that is coupled to or embedded, inset, or cast within a portion of the cooking vessel support 104, such as in a recess or groove formed in a base portion of the cooking vessel support 104. The transponder circuit 250 can be configured such that the transponder circuit 250 is in close proximity to the cooktop floor 106 when the cooking vessel support 104 is disposed on the cooktop floor 106 and in position over the gas burner 102 during operation of the cooktop. The transponder circuit 250 can be electrically connected to the temperature sensor 202, for example, by a wire (or wires) 210, such as a high temperature insulated wire, or the transponder circuit 250 can be directly connected to, or integrally formed with, the temperature sensor 202. The cooking vessel temperature monitoring and fire prevention system 200 also includes a reader circuit 260 (e.g., reader unit, module, etc.). The reader circuit 260 can be configured to be spaced a distance away (e.g., horizontally and/or vertically spaced away) from the transponder circuit 250, for example, that the reader circuit 260 and the transponder circuit 250 are not in physical contact with each other. The reader circuit 260 can be configured such that the reader circuit 260 is in close proximity to the cooktop floor 106 and the transponder circuit 250, which is integrated in the cooking vessel support 104, when the cooking vessel support 104 is disposed on the cooktop floor 106 during operation of the cooktop. In this example, the reader circuit 260 is coupled to an underside of the cooktop floor 106 such that the reader circuit 260 is in close proximity to the transponder circuit 250, while at the same time, be hidden from view.

With reference again to the examples in FIGS. 1-10D, a gas valve 500 can be provided on the gas supply line 108 for controlling a flow of gas to the gas burner 102. The gas valve 500 can be, for example, a solenoid valve, a built-in valve in a regulator, an electronic valve, a valve having a motor, actuator, positioner, etc. configured to turn the valve to various open positions, a control valve, a proportional valve, a modulating valve, etc., or a valve system having such a valve. One or more valves 500 can be on the main gas line 108 to the entire appliance, on a gas manifold, and/or on a gas line to a specific gas burner 102 of the appliance. In operation, a magnetic field is generated in the second inductor coil 262 of the reader circuit 260, which induces a voltage on the first inductor coil 252 of the transponder circuit 250 across a space, air gap, etc. between second inductor coil 262 and the first inductor coil 252, wherein the voltage is harvested by the transponder circuit 250 to power the electronic components of a sensor circuit, which includes, for example, the temperature sensor 202 on the cooking vessel support 104. Once the temperature sensor 202 is powered, the components of the transponder circuit 250 and the reader circuit 260 can enable the temperature data detected by the temperature sensor 202 to be transmitted from the temperature sensor 202 back to the reader circuit 260. A control unit 400 can be configured to receive the signal from the temperature sensor 202 via the passive wireless connection between the transponder circuit 250 and the reader circuit 260 and compare the temperature sensed by the temperature sensor 202 to one or more predetermined threshold temperatures or temperature limits ($T_L$) 406. The one or more predetermined threshold temperatures ($T_L$) 406 can be a temperature of a cooking vessel 300 supported by the cooking vessel support 104 that is less than an auto-ignition temperature of one or more types of foodstuff, oil, liquid, etc., to be heated or cooked (e.g., commonly heated or cooked) in a cooking vessel 300 by the gas burner 102. In operation, the control unit 400 can be configured to interrupt (e.g., automatically interrupt) a power supply 402, 404 to the gas valve 500 (or to control or actuate the gas valve, such as a solenoid valve, a built-in valve in a regulator, an electronic valve, a valve having a motor, actuator, positioner, etc. configured to turn the valve to various open positions, a control valve, a proportional valve, a modulating valve, etc.) in the event that a temperature of the cooking vessel 300 detected by the temperature sensor 202 reaches or exceeds (i.e., is equal to or greater than) the predetermined threshold temperature ($T_L$) 406, thereby closing the gas valve 500 and cutting off the supply of the gas through the gas supply line 108 to the gas burner 102. Additionally or alternatively, the control unit 400 can be configured to control or actuate the gas valve 500 (or to control a motor, actuator, positioner, etc. for controlling the gas valve 500) to vary or reduce the supply of the gas through the gas supply line 108 to the gas burner 102 in the event that a temperature of the cooking vessel 300 detected by the temperature sensor 202 reaches or exceeds (i.e., is equal to or greater than) the predetermined threshold temperature ($T_L$) 406, thereby varying or reducing the supply of the gas through the gas supply line 108 to the gas burner 102, thereby reducing the temperature below the predetermined threshold temperature ($T_L$) and proactively preventing the autoignition of many or most common cooking oils and fats before such autoignition occurs.

Figure 4:
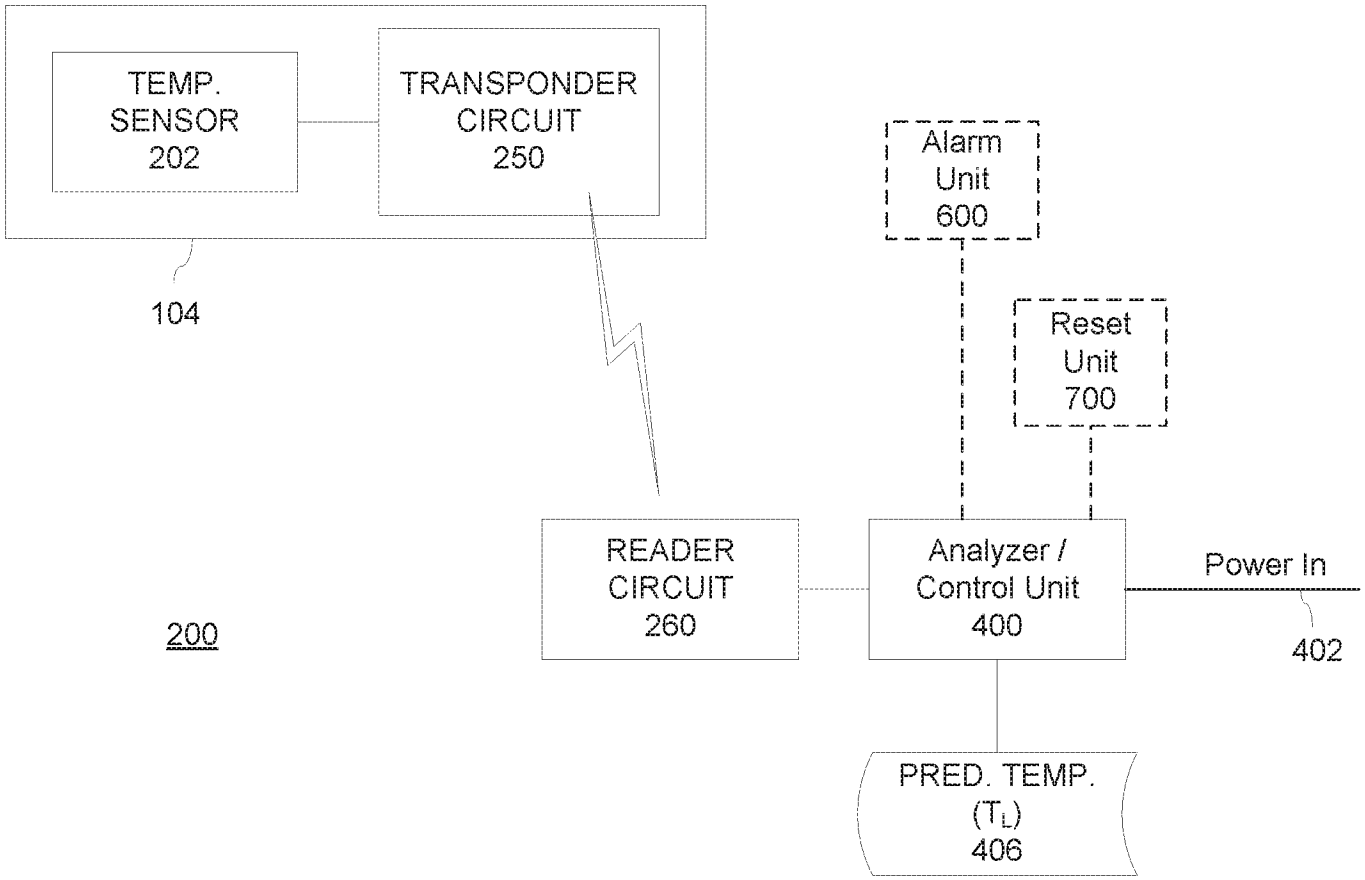
FIG. 4 is a schematic view of a cooking vessel temperature monitoring and prevention system according to an exemplary embodiment of the invention.
Figure 5:
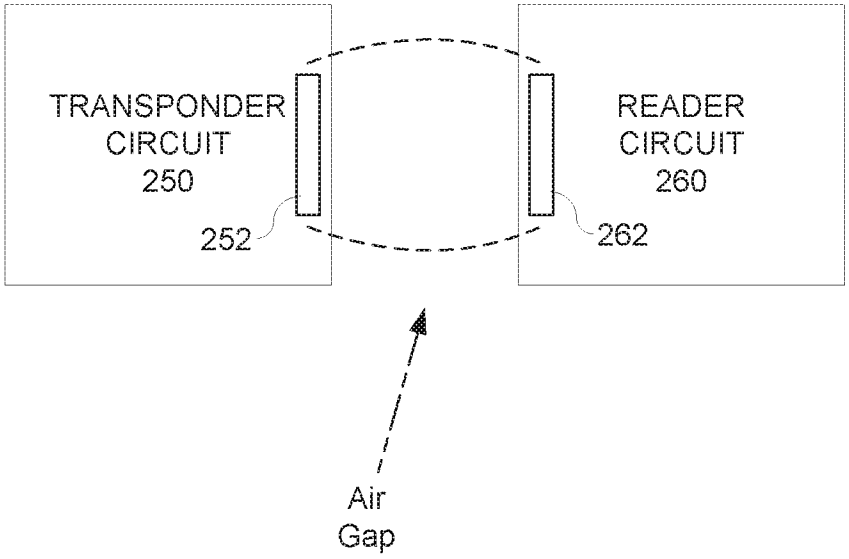
FIG. 5 is a schematic view of a transponder circuit and reader circuit arrangement of a cooking vessel temperature monitoring and prevention system according to an exemplary embodiment of the invention.

As schematically illustrated in the examples of FIGS. 2, 4, and 6, the cooking vessel temperature monitoring and fire prevention system 200 can include an alarm unit 600 in communication with the control unit 400 and/or the temperature sensor 202. The alarm unit 600 can be configured to provide an alert to a user when the temperature of the cooking vessel 300 detected by the temperature sensor 202 is equal to or greater than the predetermined threshold temperature ($T_L$) 406. The alarm unit 600 can include, for example, an audible alarm device such as an audible signal, siren, etc., a visual alarm device such as one or more indicator lights, flashing lights, a displayed alert message, etc., a notification or electronic message (e.g., a text message, app alert (e.g., computer or phone application alert), email message, and/or phone call, etc.) sent to one or more other components such as one or more remote or wireless devices, or a combination of two or more thereof. The alarm unit 600 can be a separate component, or in other examples, can be integrally provided with another component, such as the control unit 400. The alarm unit 600 can be configured to communicate (e.g., via wired or wireless communication, such as Bluetooth, Wi-Fi, cellular, optical, app communication (e.g., computer or phone application communication), Z-wave, etc.) with one or more components of the appliance, cooktop 100, control unit 400, or with one or more other devices. A remote or wireless alarm unit 600 can be arranged in communication with, or integrated into, a smart home network, one or more home systems, such as a security or monitoring system, communication system, etc., a smartphone, a personal computer, and/or another electronic device in order to alert a user.

As schematically illustrated in the examples of FIGS. 2, 4, and 6, the cooking vessel temperature monitoring and fire prevention system 200 can include a reset unit 700, such as a reset switch, button, etc., configured to re-open the gas valve 500 (e.g., solenoid valve, etc.) upon being actuated by a user. The reset unit 700 can be integrally provided with another component of the cooking vessel temperature monitoring and fire prevention system 200, or in other examples, can be a separate component. The reset unit 700 can be configured to communicate (e.g., via wired or wireless communication, such as Bluetooth, Wi-Fi, cellular, optical, app communication, Z-wave, etc.) with one or more components of the cooking vessel temperature monitoring and fire prevention system 200, such as the control unit 400, etc. In an example, a remote or wireless reset unit 700 can be arranged in communication with, or integrated into, a smart home network, one or more home systems, such as a security or monitoring system, communication system, etc., a smartphone, a personal computer, and/or another electronic device.

Figure 11:
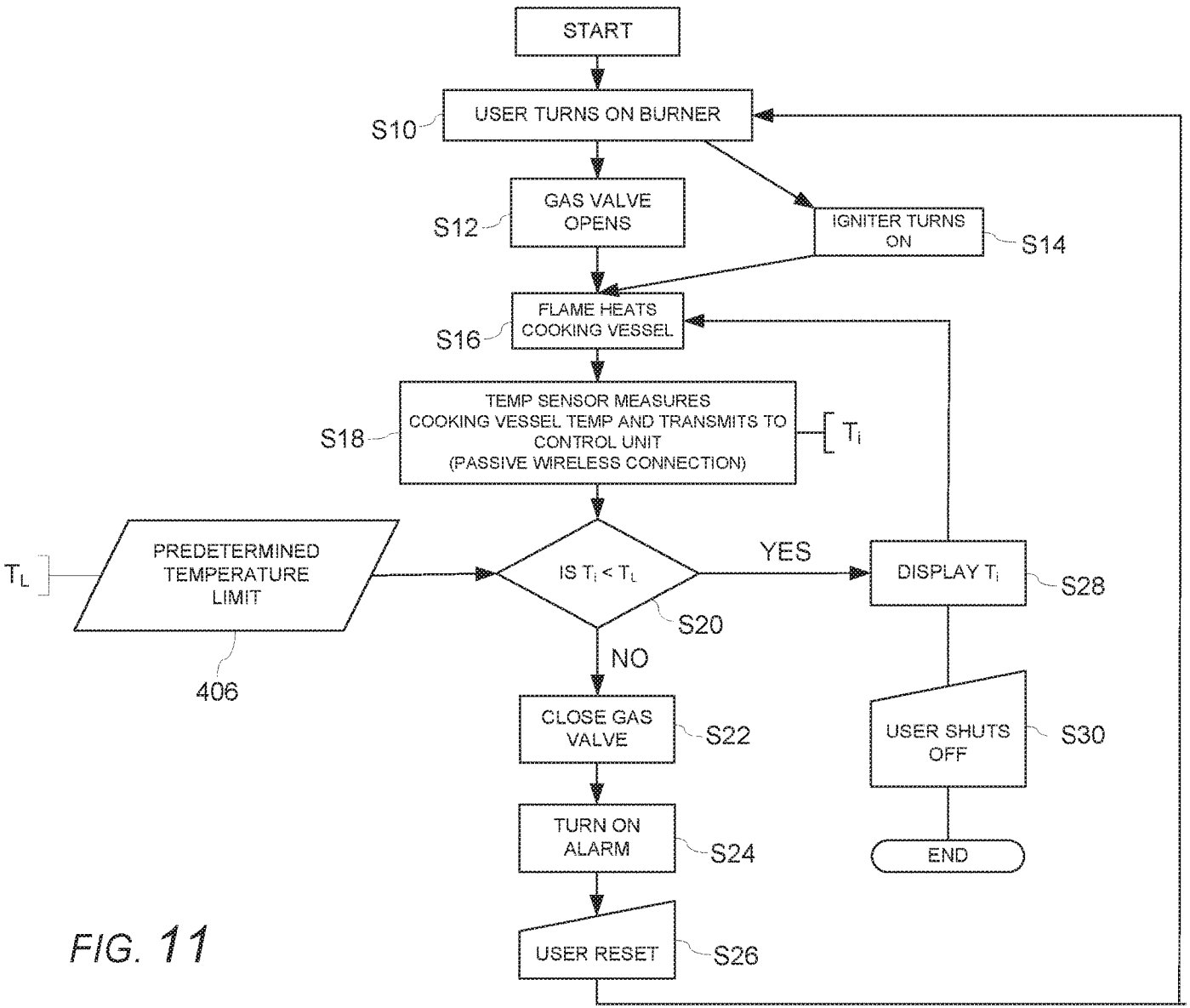
FIG. 11 is a flow diagram of a method of monitoring a gas cooktop temperature and preventing fire at the gas cooktop, according to an exemplary embodiment of the invention.
Figure 12:
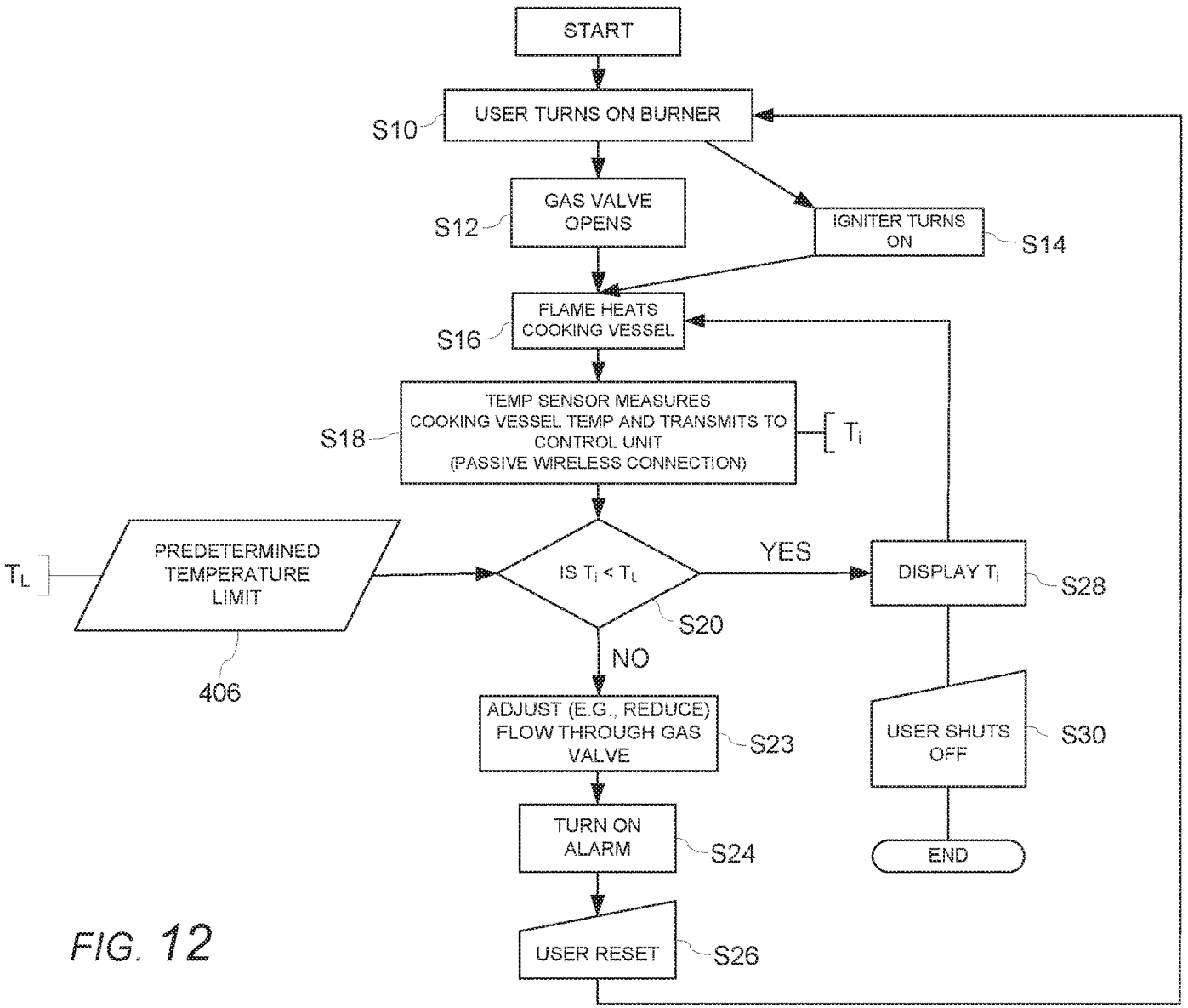
FIG. 12 is a flow diagram of a method of monitoring a cooking vessel temperature and preventing fire at a gas cooktop, according to another exemplary embodiment of the invention.
Figure 13:
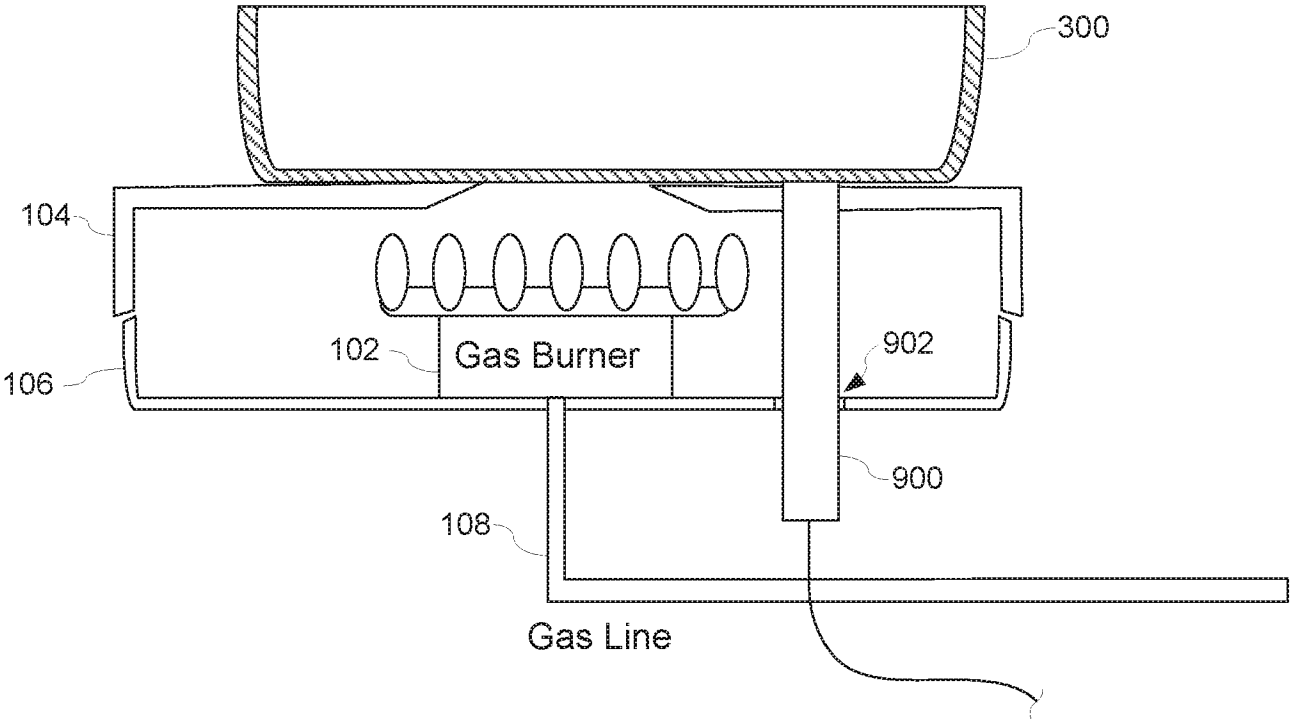
FIG. 13 (CONVENTIONAL ART)
FIG. 13 is a schematic view of a conventional cooking appliance.

With reference to FIGS. 11 and 12, examples of a method of operating a cooking vessel temperature monitoring and fire prevention system 200, according to the invention, will now be described. In operation, a user places a cooking vessel 300 on a cooking vessel support 104 of the surface cooking unit 100 and turns on a gas burner 102 (Step S10) causing a gas valve (e.g., 500) to open (Step S12). An igniter turns on (Step S14) and lights the gas exiting the gas burner 102, thereby heating the cooking vessel 300, which has been placed on the cooking vessel support 104 of the surface cooking unit 100.

The temperature sensor 202 is powered via the passive wireless connection between the transponder circuit 250 and the reader circuit 260 and then measures the temperature ($T_I$) of the cooking vessel 300 (Step S18). The components of the transponder circuit 250 and the reader circuit 260 enable the temperature data detected by the temperature sensor 202 to be transmitted from the temperature sensor 202 to the control unit 400 via the passive wireless connection between the transponder circuit 250 and the reader circuit 260. The control unit 400 compares the temperature ($T_I$) sensed by the temperature sensor 202 to one or more predetermined threshold temperatures or temperature limits ($T_L$) 406 (Step S20). The one or more predetermined threshold temperatures ($T_L$) 406 can be a temperature of a cooking vessel 300 supported by the cooking vessel support 104 that is less than an auto-ignition temperature of one or more types of foodstuff, oil, liquid, etc., to be heated or cooked (e.g., commonly heated or cooked) in a cooking vessel 300 by the gas burner 102. One or more predetermined threshold temperatures ($T_L$) 406 can be stored in a memory or database, for example, of the control unit 400, a memory or database in communication with the control unit 400, etc., or a characteristic of the temperature sensor can be selected based on a predetermined threshold temperature. If the temperature ($T_I$) measured by the temperature sensor 202 is less than the predetermined threshold temperature ($T_L$) 406, then the measured temperature ($T_I$) can be displayed, for example, on a display (Step S28) to provide the user with information for cooking, setting temperature, cook time, etc. A user can shut off the gas burner 102 and terminate the cooking process (Step S30), for example, when the cooking process is complete. As shown in FIG. 11, if the temperature $T_I$ measured by the temperature sensor 202 reaches or exceeds (i.e., is equal to or greater than) the predetermined threshold temperature ($T_L$) 406, then the control unit 400 can be configured to control the gas valve 500, for example by interrupting (e.g., automatically interrupting) a power supply 402, 404 to the gas valve 500, thereby closing the gas valve 500 and cutting off the supply of the gas through the gas supply line 108 to the gas burner 102 (Step S22), and proactively preventing the autoignition of many or most common cooking oils and fats before such autoignition occurs. Additionally or alternatively, as shown in FIG. 12, if the temperature ($T_I$) measured by the temperature sensor 202 reaches or exceeds (i.e., is equal to or greater than) the predetermined threshold temperature ($T_L$) 406, then the control unit 400 can be configured to control (e.g., automatically control) the gas valve 500, thereby adjusting the gas valve 500 and adjusting/reducing the supply of the gas through the gas supply line 108 to the gas burner 102 (Step S23), thereby adjusting/reducing the temperature below the predetermined threshold temperature ($T_L$) and proactively preventing the autoignition of many or most common cooking oils and fats before such autoignition occurs.

In some examples, the control unit 400 can be configured to activate an alarm unit 600 to provide an alert to a user (Step S24) of a possible or impending fire event, as well as to notify the user that the cooking process has been interrupted by the step of cutting off the gas supply to the gas burner 102, as shown in FIG. 11, or that the cooking process has been modified by adjusting/reducing the flow of the gas supply to the gas burner 102, as shown in FIG. 12. The examples of the cooking vessel temperature monitoring and fire prevention system 200 (e.g., the control unit 400) can be configured to work with one or more electronic valves of an electronic valving system, or the like, to automatically adjust (i.e., without user intervention) a gas flow rate (heat output) to control the temperature ($T_I$) of the cooking vessel 300, for example, by cutting off the gas supply to the gas burner 102, as shown in FIG. 11, and/or by reducing the flow of the gas supply to the gas burner 102, as shown in FIG. 12. In some examples, the control unit 400 can be configured to control the temperature ($T_I$) of the cooking vessel 300, for example, by initially reducing the flow of the gas supply to the gas burner 102 if the temperature ($T_I$) measured by the temperature sensor 202 reaches or exceeds (i.e., is equal to or greater than) the predetermined threshold temperature ($T_L$) 406, as shown in FIG. 12. The cooking vessel temperature monitoring and fire prevention system 200 can be configured to continuously monitor the temperature of the cooking vessel 300 and to take additional steps of further reducing the flow of the gas supply to the gas burner 102, or cutting off the flow of the gas supply to the gas burner 102 altogether. For example, if, after the flow of the gas supply to the gas burner 102 has been reduced, the temperature ($T_I$) measured by the temperature sensor 202 continues to be equal to or greater than the predetermined threshold temperature ($T_L$) 406, then the cooking vessel temperature monitoring and fire prevention system 200 (e.g., the control unit 400) can be configured to adjust one or more electronic valves of an electronic valving system to further reduce the flow of the gas supply to the gas burner 102 until the temperature ($T_I$) measured by the temperature sensor 202 is less then the predetermined threshold temperature ($T_L$) 406 and/or to completely cut off the gas supply to the gas burner 102.

With reference again to FIGS. 11 and 12, the control unit 400 can be configured to activate an alarm unit 600 (Step S24) to provide an alert to a user of a possible or impending fire event, as well as to notify the user that the cooking process has been interrupted by the step of cutting off of the gas supply to the gas burner 102 (Step S22), as shown in FIG. 11, and/or that the cooking process has been modified by adjusting/reducing the flow of the gas supply to the gas burner 102 (Step S23), as shown in FIG. 12. In some examples, the cooking vessel temperature monitoring and fire prevention system 200 (e.g., the control unit 400) can be configured to activate the alarm unit 600 (Step S24) to provide one or more alerts (e.g., different alerts), such as a first alert to a user of a possible or impending fire event and to notify the user that the cooking process has been modified by reducing the flow of the gas supply to the gas burner 102, as shown in FIG. 12, and to provide a second alert to the user of a possible or impending fire event and to notify the user that the cooking process has been interrupted by the step of cutting off the gas supply to the gas burner 102, as shown in FIG. 11. In some examples, the first alert and the second alert can be configured to be different or distinguishable depending on the circumstance (e.g., reducing gas flow, cutting off gas flow, etc.) such that a user can differentiate between the circumstances being monitored and detected by the cooking vessel temperature monitoring and fire prevention system 200 and for which the user is being notified.

As shown in the examples of FIGS. 11 and 12, if the user determines that a fire event is not imminent or in progress, or if the temperature ($T_I$) of the cooking vessel 300 drops below the predetermined threshold temperature ($T_L$) 406, then the user can reset the cooking vessel temperature monitoring and fire prevention system 200 using a reset unit 700 (Step S26), such as a reset switch, by turning the gas burner 102 back on (S10), and/or by readjusting the gas burner 102 to a desired setting (e.g., the original setting, a new setting, etc.).

One of ordinary skill in the art will recognize that other arrangements and processes are possible within the spirit and scope of the examples illustrated, for example, in FIGS. 1-12.

In other embodiments, the temperature signal (e.g., $T_I$) supplied by the temperature sensor 202 via the passive wireless connection between the transponder circuit 250 and the reader circuit 260 can be processed, for example, by the control unit 400, and used as an input for a thermostat control of one or more gas burners 102 of the cooktop. For example, in an instance in which a piece of cold meat or other cold foodstuff is placed in a cooking vessel 300, which is on a cooking vessel support 104 above the gas burner 102, the temperature of the cooking vessel 300 typically quickly drops. The examples of the cooking vessel temperature monitoring and fire prevention system 200 (as shown for example in FIGS. 1-12) can be configured to detect such a temperature deviation from the targeted temperature (e.g., temperature drop) using the temperature sensor 202, which is integrated into the cooking vessel support 104, and then, in response to the temperature signal (e.g., $T_I$) supplied by the temperature sensor 202 via the passive wireless connection between the transponder circuit 250 and the reader circuit 260 to the control unit 400, increase a burner setting (e.g., open a gas valve 500 by a larger amount to increase an amount of gas supplied to a gas burner 102) of a gas burner 102 to increase an amount of heat (e.g., BTU's) applied to the cooking vessel 300. As the difference between the temperature ($T_I$) of the cooking vessel 300 and the target temperature decreases, the control unit 400 (e.g., a logic controller) can be configured to control (e.g., automatically control, actuate, modulate, etc.) a gas valve 500 (e.g., an electronic valve of an electronic valving system, a motor, actuator, positioner, etc. configured to turn a valve to various open positions, a control valve, a proportional valve, a modulating valve, or the like) to reduce or adjust the amount of gas/heat being supplied to the cooking vessel 300 by the gas burner 102. In some examples, the control unit 400 can be configured to include a thermostat control for one or more gas burners of the cooktop. In other examples, the thermostat control can be a separate component or part of a separate control unit or system for controlling the gas burners or other components of the cooktop. In these and other examples, the cooking vessel temperature monitoring and fire prevention system 200 can be configured to allow a user to monitor the temperature ($T_I$) of the cooking vessel 300, thereby giving the user the ability to better control the desired temperature of the cooking vessel 300 during a cooking operation. The examples of the cooking vessel temperature monitoring and fire prevention system 200 can be configured to work with or control, for example, one or more valves (e.g., an electronic valve of an electronic valving system, a motor, actuator, positioner, etc. configured to turn a valve to various open positions, a control valve, a proportional valve, a modulating valve, or the like) to automatically adjust (i.e., without user intervention) a gas flow rate (heat output) to control the temperature ($T_I$) of the cooking vessel 300.

In other examples, the cooking vessel temperature monitoring and fire prevention system 200 (as shown for example in FIGS. 1-12) can be configured to allow a user to set a desired temperature of the cooking vessel 300, a level or mode (e.g., boil, simmer, etc.), etc. for the cooking operation, for example, using a user input (e.g., control panel, control knob, computer application, phone application, etc.). In response to the user setting, the system 200 can be configured to measure the temperature ($T_I$) of the cooking vessel 300 using the temperature sensor 202, and then the temperature signal ($T_I$) supplied by the temperature sensor 202 can be processed, for example, by the control unit 400, and used modulate the flow of gas supplied to the gas burner 102 to control the desired temperature of the cooking vessel 300 and achieve the desired results during a cooking operation.

With reference again to FIGS. 1-12, exemplary embodiments of the invention include a cooking appliance (e.g., 100) having a cooking vessel temperature monitoring and fire prevention system (e.g., 200), the cooking appliance (e.g., 100) comprising a gas burner (e.g., 202), a cooking vessel support (e.g., 104) configured to support a cooking vessel (e.g., 300) above the gas burner (e.g., 102), a temperature sensor (e.g., 202) integrated with the cooking vessel support (e.g., 104), the temperature sensor (e.g., 202) configured to be in thermal contact with the cooking vessel (e.g., 300) supported on the cooking vessel support (e.g., 104) and to detect the temperature of the cooking vessel (e.g., 300), a control unit (e.g., 400) configured to control an operation of the cooking appliance based on the temperature of the cooking vessel (e.g., 300) detected by the temperature sensor (e.g., 202), and a passive wireless connection (e.g., 250/260) between the temperature sensor (e.g., 202) and the control unit (e.g., 400), the passive wireless connection including a transponder circuit (e.g., 250) integrated with the cooking vessel support (e.g., 104) and in communication with the temperature sensor (e.g., 202), and a reader circuit (e.g., 260) spaced a distance away (e.g., horizontally and/or vertically spaced away) from the transponder circuit (e.g., 250), the reader circuit (e.g., 260) in communication with the control unit (e.g., 400). The transponder circuit (e.g., 250) can include a first inductor coil component (e.g., 252) and the reader circuit (e.g., 260) can include a second inductor coil component (e.g., 262), wherein the second inductor coil component (e.g., 262) is configured to generate a magnetic field across a space to the first inductor coil (e.g., 252) to power the temperature sensor (e.g., 202) on the cooking vessel support 104 and transmit the temperature of the cooking vessel (e.g., 300) detected by the temperature sensor (e.g., 202) to the control unit (e.g., 400). The cooking appliance (e.g., 100) can include a thermal insulation (e.g., 204) integrated with the cooking vessel support (e.g., 104) and separating the temperature sensor (e.g., 204) from the cooking vessel support (e.g., 104). The cooking appliance (e.g., 100) can further include a thermally conductive substrate (e.g., 212) integrated with the cooking vessel support (e.g., 104), the thermally conductive substrate (e.g., 212) arranged in thermal contact with the temperature sensor (e.g., 202), wherein an upper surface of the thermally conductive substrate (e.g., 212) is configured to directly contact a surface of the cooking vessel (e.g., 300) supported by the cooking vessel support (e.g., 104), and wherein the thermal insulation (e.g., 204) separates the thermally conductive substrate (e.g., 212) from the cooking vessel support (e.g., 104).

In these and other ways, the integral temperature sensor on the cooking vessel support can be monitored remotely using passive wireless communication without direct wiring or a mechanical connection between the cooking vessel support having the integral temperature sensor and other components of the appliance, thereby facilitating simple and easy removal of the cooking vessel support from the cooking appliance for cleaning, repairs, etc., while minimizing or reducing a risk of damage to components during removal of the cooking vessel support. The examples of the present invention also can provide a cooking appliance having a gas surface cooking unit and a gas cooktop fire prevention system that can simply, easily, and proactively prevent the autoignition of many or most common cooking oils and fats resulting from overheating a cooking vessel on the gas surface cooking unit before such autoignition occurs, and/or that can provide thermostat control of the cooking appliance, while at the same time providing a gas cooktop fire prevention system that can be implemented easily and inexpensively, and that does not detract from aesthetics of the appliance or hinder the cleanability of the appliance. Additionally or alternatively, the examples of the present invention also can provide a cooking appliance having a gas surface cooking unit and a cooking vessel temperature monitoring and fire prevention system that can remotely monitor the temperature ($T_I$) of the cooking vessel via the passive wireless connection, thereby giving the user the ability to better control the desired temperature of the cooking vessel during a cooking operation. Additionally or alternatively, the examples of the present invention further can provide a cooking appliance having a gas surface cooking unit and a cooking vessel temperature monitoring and fire prevention system that can allow a user to set a desired temperature of the cooking vessel, a level or mode (e.g., boil, simmer, etc.), and in response to the user setting, can modulate (e.g., automatically modulate) the flow of gas supplied to the gas burner to control the desired temperature of the cooking vessel and achieve the desired results during a cooking operation.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A cooking appliance having a cooking vessel temperature monitoring and fire prevention system, the cooking appliance comprising:

a gas burner;

a cooking vessel support configured to support a cooking vessel above the gas burner;

a temperature sensor integrated with the cooking vessel support, the temperature sensor configured to be in thermal contact with the cooking vessel supported on the cooking vessel support and to detect the temperature of the cooking vessel;

a control unit configured to control an operation of the cooking appliance based on the temperature of the cooking vessel detected by the temperature sensor;

a passive wireless connection between the temperature sensor and the control unit, the passive wireless connection including:

a transponder circuit integrated with the cooking vessel support and in communication with the temperature sensor; and a reader circuit spaced a distance away from the transponder circuit, the reader circuit in communication with the control unit; and a thermal insulation integrated with the cooking vessel support and separating the temperature sensor from the cooking vessel support, wherein an upper surface of the temperature sensor is configured to directly contact a surface of the cooking vessel supported by the cooking vessel support.

2. The cooking appliance of claim 1, wherein the transponder circuit includes a first inductor coil and the reader circuit includes a second inductor coil, wherein the second inductor coil is configured to generate a magnetic field across a space between the first inductor coil and the second inductor coil to power the temperature sensor on the cooking vessel support and transmit the temperature of the cooking vessel detected by the temperature sensor to the control unit.

3. The cooking appliance of claim 1, further comprising a cooktop floor, wherein the reader circuit is disposed under the cooktop floor.

4. The cooking appliance of claim 3, the reader circuit is coupled to an underside of the cooktop floor such that the reader circuit is in close proximity to the transponder circuit.

5. The cooking appliance of claim 3, wherein the transponder circuit is disposed in a surface of the cooking vessel support adjacent to the cooktop floor.

6. The cooking appliance of claim 1, wherein the transponder circuit is disposed in a recess in a surface of the cooking vessel support.

7. The cooking appliance of claim 1, wherein the transponder circuit is integrally formed with the cooking vessel support.

8. The cooking appliance of claim 1, further comprising:

a wire extending through at least a portion of the cooking vessel support, the wire having a first end coupled to the temperature sensor and a second end coupled to the transponder circuit.

9. The cooking appliance of claim 8, wherein the cooking vessel support includes a cavity and the wire is disposed in the cavity.

10. The cooking appliance of claim 8, wherein the wire is embedded in the cooking vessel support.

11. The cooking appliance of claim 1, further comprising:

a gas supply line supplying gas to the gas burner; and a gas valve on the gas supply line, wherein the control unit is in communication with the temperature sensor and the gas valve, and the control unit is configured to control the gas valve and cut off a supply of the gas through the gas supply line to the gas burner when the temperature of the cooking vessel detected by the temperature sensor and transmitted to the control unit via the passive wireless connection is equal to or greater than a predetermined threshold temperature of the cooking vessel.

12. The cooking appliance of claim 11, further comprising:

an alarm unit in communication with the control unit, wherein the control unit activates the alarm unit to provide an alert to a user when the temperature of the cooking vessel detected by the temperature sensor is equal to or greater than the predetermined threshold temperature of the cooking vessel.

13. The cooking appliance of claim 11, further comprising:

a reset switch configured to re-open the gas valve upon being actuated by a user.

14. The cooking appliance of claim 11, wherein the gas supply line supplies the gas to a plurality of gas burners including the gas burner.

15. The cooking appliance of claim 11, wherein the gas supply line supplies the gas only to the gas burner.

16. The cooking appliance of claim 1, further comprising:

a gas supply line supplying gas to the gas burner; and a gas valve on the gas supply line, wherein the control unit in communication with the temperature sensor and the gas valve, and wherein the control unit is configured to control the gas valve to adjust a supply of the gas through the gas supply line to the gas burner based on the temperature of the cooking vessel detected by the temperature sensor and transmitted to the control unit via the passive wireless connection.

17. The cooking appliance of claim 1, wherein the temperature sensor and the thermal insulation are one of:

disposed in a recess in a surface of the cooking vessel support; and integrally formed with the cooking vessel support.

18. The cooking appliance of claim 1, further comprising:

a thermally conductive substrate integrated with the cooking vessel support, the thermally conductive substrate arranged in thermal contact with the temperature sensor, wherein an upper surface of the thermally conductive substrate is configured to directly contact a surface of the cooking vessel supported by the cooking vessel support.

19. The cooking appliance of claim 18, further comprising:

the thermal insulation separating the thermally conductive substrate from the cooking vessel support, wherein the thermally conductive substrate, the temperature sensor, and the thermal insulation are one of:

disposed in a recess in a surface of the cooking vessel support; and integrally formed with the cooking vessel support.

20. The cooking appliance of claim 18, wherein at least a portion of the cooking vessel support is formed of a thermally insulating material, and wherein the thermally conductive substrate and the temperature sensor are integrated with the portion of the cooking vessel support.

* * * * *